US008550901B2

(12) United States Patent
Walker et al.

(10) Patent No.: US 8,550,901 B2
(45) Date of Patent: Oct. 8, 2013

(54) WAGERING GAME BENEFITS REDEEMABLE AT ANOTHER GAMING DEVICE

(75) Inventors: Jay S. Walker, Ridgefield, CT (US); Russell P. Sammon, San Francisco, CA (US); Robert C. Tedesco, Fairfield, CT (US); James A. Jorasch, New York, NY (US); Daniel E. Tedesco, Shelton, CT (US); Jeffrey Y. Hayashida, San Fransico, CA (US)

(73) Assignee: IGT, Las Vegas, NV (US)

( * ) Notice: Subject to any disclaimer, the term of this patent is extended or adjusted under 35 U.S.C. 154(b) by 1206 days.

(21) Appl. No.: 11/420,617

(22) Filed: May 26, 2006

(65) Prior Publication Data

US 2007/0275777 A1 Nov. 29, 2007

(51) Int. Cl.
*A63F 9/24* (2006.01)

(52) U.S. Cl.
USPC ..... 463/25; 463/16; 463/17; 463/18; 463/19; 463/20; 463/21

(58) Field of Classification Search
USPC ..... 463/16–20, 21, 25
See application file for complete search history.

(56) References Cited

U.S. PATENT DOCUMENTS

| | | | | |
|---|---|---|---|---|
| 5,551,692 | A | 9/1996 | Pettit et al. | 373/143 R |
| 5,816,918 | A | 10/1998 | Kelly et al. | 463/16 |
| 6,575,832 | B1 | 6/2003 | Manfredi et al. | 463/25 |
| 6,648,759 | B2 | 11/2003 | Vancura | 463/20 |
| 6,685,564 | B2 | 2/2004 | Oliver | 463/25 |
| 6,758,755 | B2 * | 7/2004 | Kelly et al. | 463/42 |
| 6,800,030 | B2 * | 10/2004 | Acres | 463/25 |
| 6,811,486 | B1 * | 11/2004 | Luciano, Jr. | 463/24 |
| 6,835,134 | B2 | 12/2004 | Poole et al. | 463/25 |
| 7,008,320 | B2 * | 3/2006 | Rowe et al. | 463/25 |
| 7,156,741 | B2 | 1/2007 | Hornik et al. | |
| 2003/0013515 | A1 * | 1/2003 | Rowe et al. | 463/25 |
| 2005/0043087 | A1 * | 2/2005 | Seelig et al. | 463/25 |
| 2005/0250569 | A1 * | 11/2005 | Kane et al. | 463/16 |
| 2006/0046816 | A1 * | 3/2006 | Walker et al. | 463/13 |
| 2006/0046839 | A1 * | 3/2006 | Nguyen | 463/25 |
| 2006/0258433 | A1 * | 11/2006 | Finocchio et al. | 463/16 |
| 2007/0191084 | A1 | 8/2007 | Tarantino | |
| 2007/0218968 | A1 * | 9/2007 | Snow et al. | 463/13 |

OTHER PUBLICATIONS

Brochure: "EZ Pay™ Ticket System", IGT, Copyright 2004, 5 pp.

* cited by examiner

*Primary Examiner* — Werner Garner
(74) *Attorney, Agent, or Firm* — Neal, Gerber & Eisenberg LLP

(57) ABSTRACT

Methods and apparatus are described for offering a benefit to a player of a first electronic game device. In an embodiment, the method includes determining if a player of a first electronic game device qualifies to receive at least one benefit associated with an award value, and then outputting an offer to provide the at least one benefit. In some embodiments, the offer requires use of a second electronic game device. The method may also include receiving a request for the benefit at the second electronic game device, and then providing at least one benefit to the player. In some embodiments, the offer includes such benefits as additional game play, one or more bonus-round game outcomes, a monetary payout, a game play modification, additional comp points, loss insurance, a multimedia option, and acquisition of at least one unit of media content.

61 Claims, 13 Drawing Sheets

400

| | RANDOM NUMBER (RANGE) 402 | OUTCOME 404 |
|---|---|---|
| R400-1 | 1-8570 | NONWINNING COMBINATION |
| R400-2 | 8571-9250 | CHERRY / ANY / ANY |
| R400-3 | 9251-9930 | ANY / ANY / CHERRY |
| R400-4 | 9931-10130 | CHERRY / CHERRY / ANY |
| R400-5 | 10131-10330 | ANY / CHERRY / CHERRY |
| R400-6 | 10331-10398 | CHERRY / ANY / CHERRY |
| R400-7 | 10399-10418 | CHERRY / CHERRY / CHERRY |
| R400-8 | 10419-10460 | BAR / ORANGE / ORANGE |
| R400-9 | 10461-10466 | ORANGE / ORANGE / BAR |
| R400-10 | 10467-10508 | ORANGE / ORANGE / ORANGE |
| R400-11 | 10509-10515 | WHEEL / WHEEL / WHEEL |
| R400-12 | 10516-10518 | GD 3 SPIN / GD 3 SPIN / GD 3 SPIN |
| R400-13 | 10519-10520 | BONUS / BONUS / BONUS |
| R400-14 | 10521 | BONUS 2 / BONUS 2 / BONUS 2 |

FIG. 4A 400 (CONT.)

| OUTCOME IDENTIFIER 406 | REDEMPTION DEVICE 408 | PAYOUT 410 | |
|---|---|---|---|
| O-000001 | GD-000001 | 0 | R400-1 |
| O-000002 | GD-000001 | 2 | R400-2 |
| O-000003 | GD-000001 | 2 | R400-3 |
| O-000004 | GD-000001 | 5 | R400-4 |
| O-000005 | GD-000001 | 5 | R400-5 |
| O-000006 | GD-000001 | 5 | R400-6 |
| O-000007 | GD-000001 | 20 | R400-7 |
| O-000008 | GD-000001 | 10 | R400-8 |
| O-000009 | GD-000001 | 10 | R400-9 |
| O-000010 | GD-000001 | 20 | R400-10 |
| O-000011 | GD-000002 | 40 | R400-11 |
| O-000012 | GD-000003 | SPIN | R400-12 |
| O-000013 | GD-000004-GD-000999 | 75 (EV) | R400-13 |
| O-000014 | GD-000004-GD-000999 | 150 (EV) | R400-14 |

FIG. 4B

500

| | PLAYER IDENTIFIER 502 | OUTCOME 504 | OUTCOME IDENTIFIER 506 | REDEMPTION DEVICE 508 | BENEFIT DUE 510 |
|---|---|---|---|---|---|
| R500-1 | P-000001 | WHEEL / WHEEL / WHEEL | O-000011 | GD-000002 | 40 |
| R500-2 | P-000354 | GD 3 SPIN / GD 3 SPIN / GD 3 SPIN | O-000012 | GD-000003 | SPIN |
| R500-3 | P-023452 | BONUS / BONUS / BONUS | O-000012 | GD-000004, GD-000999 | 75 (EV) |
| R500-4 | P-009936 | BONUS 2 / BONUS 2 / BONUS 2 | O-000013 | BANK A, ROOM Z | 150 (EV) |
| R500-5 | P-002983 | KEY / KEY / KEY | O-000014 | GD-001234 | UNLOCK PRIZE |

FIG. 5

WAGERING GAME BENEFITS REDEEMABLE AT ANOTHER GAMING DEVICE

CROSS REFERENCE TO RELATED APPLICATIONS

The present application is related to U.S. patent application Ser. No. 09/597,801 filed Jun. 20, 2000, entitled "GAMING TOKEN HAVING A VARIABLE VALUE", which claims the benefit of U.S. Provisional Patent Application No. 60/202,573 filed May 10, 2000.

FIELD OF THE INVENTION

The present invention generally relates to electronic Game Devices (GDs), such as slot machines, video poker machines and pachinko machines that are used by players to play wagering games. More specifically, the present invention relates to methods and apparatus for determining that a player of a first GD qualifies for a benefit associated with an award value, and if so, providing an offer that requires the player to redeem the benefit at a second GD. For example, a player may qualify to receive an offer for additional game play by using a second GD that is located in a different part of the casino.

Advantages and features of the invention will become apparent upon reading the contents of this document, and the nature of the invention may be more clearly understood by reference to the following detailed description of the invention, the appended claims and to the drawings attached hereto.

BRIEF DESCRIPTION OF THE DRAWINGS

FIGS. 4A and 4B depict a tabular representation of an example of a game results table of a GD according to an embodiment of the invention;

FIG. 5 is a tabular representation of a benefits due database according to an embodiment of the invention;

DETAILED DESCRIPTION OF THE INVENTION

Figure 1A:
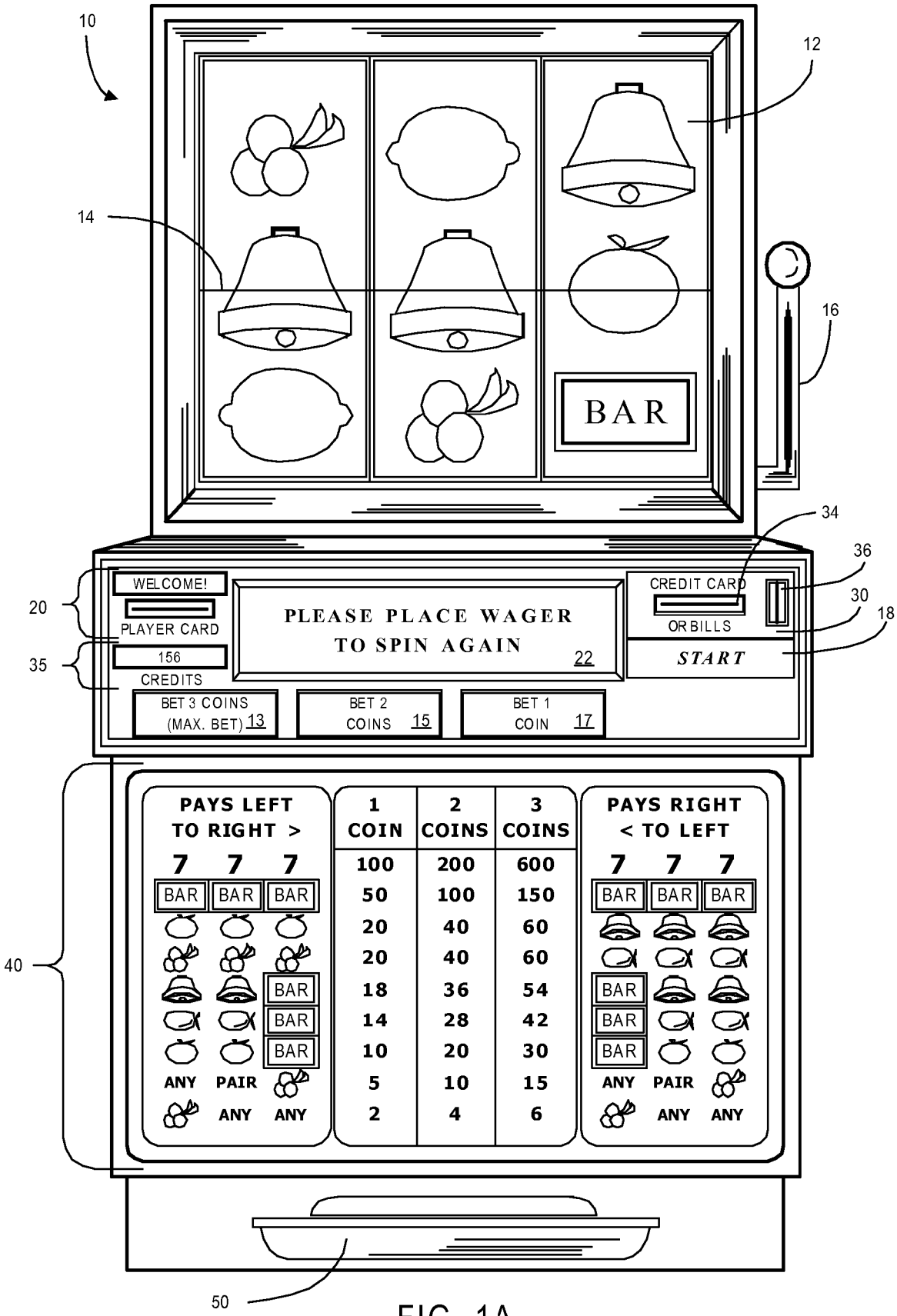
FIG. 1A is a plan view of an embodiment of an example of an electronic Game Device (GD) of a type adapted for use with the present invention.

Applicants have recognized that it would be advantageous to, without interrupting an already-profitable behavioral pattern, steer a player from one electronic game device (GD) such as a slot machine to a different GD to redeem a spin or payout. For example, a player might win a "spin" on a first GD, and be directed to a second GD to play the spin. In a particular example, a player might play a "standard" GD, and win a bonus-round game entry or spin that is exclusively redeemable at a special "bonus-round only" GD that is positioned at a central location on a slot floor of a casino.

There are numerous potential benefits to both players and casinos for directing players to other GDs for the purpose of redeeming a spin or payout. For example, casinos and GD manufacturers wish to encourage players to try new GDs, and can thus provide benefits and/or incentives (e.g., a player is awarded one free bonus spin on a new brand of slot game at a GD that is physically located at a remote site which may be a short or a long distance away from the first GD). In an embodiment, patrons may be steered to redeem winnings at a visible, central location on a slot floor, so that the players' big wins become a visible event (e.g., taking place at a large machine such as a "Mega"-GD in a high-traffic area). Such "big win" events may excite onlookers and motivate them to gamble. Moreover, the casino is given some added general flexibility concerning managing the flow of players on the slot machine floor. That is, by providing a potentially small benefit, players may be driven to particular areas or to particular GDs as the casino sees fit.

In some embodiments, players may be provided with additional benefits in situations where they redeem at a second GD a payout or spin won at a first GD. For example, players may be given an additional monetary benefit (e.g., a 20% bonus on top of any winnings resulting from a particular spin). Additionally, in some embodiments, players redeeming a spin or payout at a second GD may find the second GDs ability to execute a game play and/or provide such a payout or spin to be more entertaining, immersive, or otherwise enjoyable (e.g., more than the first GDs ability). For example, if the second GD is a "bonus-round only" device that redeems bonus round entries provided by other GDs, without the need to accommodate "traditional" game play or wagering (e.g., the "bonus-round only" device doesn't need a robust dashboard of wagering and/or payline options), such a device may allow for a more robust bonus-round experience. For example, a "bonus-round only" device may feature an oversized, electromechanical bonus wheel, large display screens, surround sound, and possibly some other over-sized or "extreme" features. Such "bonus-round only" Gds may also contain instructions on a display, for example, that are visible to persons who pass by (such as casino patrons and/or players) explaining how to win spins and/or which other GDs may be used to achieve game play on that GD. Players may perceive that the ability to utilize such a "bonus-round only" second GD is a privilege, and may be happy that other patrons see them playing the second GD.

In some situations, the practice of directing a player of a first GD to a second GD may be unnecessary, inadvisable (e.g., the player is enjoying himself and should not be disturbed), unprofitable (e.g., the player is generating substantial revenue through play of the first GD) or otherwise unacceptable to a casino. Thus, in an embodiment, the method and system includes various rules (e.g., stored in electronic memory and utilized by one or more software programs of a GD and/or a casino server and/or a Gaming Server (GS) or the like) that may be put in place to determine when players may receive and/or redeem such additional spins and/or payouts. For example, the casino may only offer the provision and/or redemption of such benefits (which may be additional spins) and/or payouts at various times of the day, for certain players, for large payout amounts, and/or when utilization with respect to certain GDs is beneath a certain threshold. Further, methods are contemplated for motivating the players to go back to the GDs that they were initially playing on the slot floor after they are finished using the second GD (e.g., a dual-value cashout option provides more "promotional" or non-cashable value at certain standard GDs (e.g., 110 promotional credits) on the floor than for simply being cashed out (e.g., for a monetary equivalent of 100 credits)).

For example, a player who is playing a standard video slot machine GD may achieve an outcome of "Wheel-Wheel-Wheel". However, rather than trigger the bonus round immediately at the GD that he's playing, the screen indicates: "Congratulations, you've won a spin of our Mega Bonus Wheel in the center of the room! Just insert your cashout ticket from this machine at any time to redeem your spin." The standard video slot machine (or server in communication therewith) also determines and stores an award value, which may be an expected value (EV) due to the player in association with the bonus spin. (For example, the EV may be equivalent to the sum of the probability of each possible outcome the player may later receive multiplied by the outcome's payout.) In order to take advantage of the additional game play (which may also be thought of as acquiring an additional gaming output), the player later inserts his cashout ticket at the Mega Bonus Wheel GD. When the cashout ticket is inserted, the Mega Bonus Wheel device (i) looks up the predetermined award value (for example, an EV) that is due to the player (e.g., a central database may store a value such as "100" coins), and then (ii) provides the EV by generating a random game result that yields the EV. (For example, by way of the random result, some players win 80 coins, some players win 100 coins, and other players win 120 coins. But in the long run 100 coins are paid out on average to players who are due and/or presenting an EV of 100 coins).

In another example, rather than indicate an award value which may be provided to a player, a cashout ticket or other type of ticket or voucher may indicate a probability table and/or a payout table against which a random result is to be determined by the second device (e.g., the ticket indicates "Bonus round pool BP-X10292," referring to a table or a database that stores a variety of bonus payout amounts with probabilities and random number ranges associated therewith). But in some other embodiments, a player may be presented with a display of several "masked" rewards boxes that each conceals a payout amount, wherein the payout amounts are not associated with probability or payout tables.

In some embodiments, such a second GD or "bonus-only" device may recall or otherwise obtain and then output the "bonus-triggering" outcome the player initially achieved at the first machine. For example, before providing an elaborate bonus round animation sequence, a second GD or bonus-only device may obtain and "replay" the original "Wheel-Wheel-Wheel" outcome the player achieved on a standard GD, such as a slot machine, which serves as a thematic reminder of how the player gained access to the bonus-only device.

It should be understood that, although a slot machine type of GD was discussed in the examples above, the present methods are also applicable to other GDs that offer different types of wagering games, including but not limited to, video poker machines, video blackjack machines, keno terminals, a pachinko machine, a GD offering a table-top game, a personal computer, a telephone or cell phone, a portable handheld gaming device (e.g., a personal digital assistant (PDA), a wireless intra-property handheld wagering device, a Nintendo® GameBoy®, and the like), a skill crane, a skee-ball machine, and/or hardware positioned adjacent to or in association with a table game (for example, blackjack or craps) that is configured to accept, for example, cashout tickets or vouchers with such bonus round information and/or player identification and/or bet input. It is noted that applying the methods disclosed herein to interactive games, such as video poker or video blackjack, may be beneficial because it may encourage players to try out new or different GDs that they would not ordinarily utilize when visiting the casino.

It has been recognized that organizations, such as casinos, who have or are planning large-scale deployments of networked GDs may implement the idea of a single logical Electronic Game Server (GS) that transmits gaming computations and instructions by utilizing multiple physical Electronic Game Servers. In addition, a multi-layer architecture (such as Model-View-Controller) may be used that may result in more than one logical grouping of functions in the GS implementation. In these implementations, a single request for game play from a GD of a plurality of GDs can be satisfied by a large number of possible combinations of physical devices. A "gaming request", which is a solicitation by a GD for data that will be used to formulate at least a portion of a gaming outcome, may be made substantially simultaneously by a plurality of GDs in a thin client system. For example, a GD may make a gaming request for five cards, for three icons representing a combination for display for a three-reel slot machine, for the generation of random numbers, and/or for a mapping of random numbers to game parameters such as cards, dice, reel icons and the like. The requested functions may be handled by a GS or other device that may be a component of a gaming system (such as a gaming network that includes one or more casino or gaming servers and one or more GDs) and then provided to the GD. The GS may also handle some or all of the functions associated with determining if players qualify to receive benefits, providing offers to the players, and/or providing benefit parameters to, for example, bonus-round only GDs.

A need therefore exists for methods and apparatus that permit players to obtain benefits, such as additional game play, that requires use of a second GD, which may be a bonus-round only device and/or a GD that plays a different type of wagering game, or some other device, to obtain the benefits. Methods, apparatus and systems in accordance with those disclosed avoid the shortcomings of prior art systems by making it simple, easy and exciting for players to obtain the benefits to which they are entitled. The methods, apparatus and systems also may include components configured to collect data associated with the benefits, such as the types of offers for benefits that are made to players, and data associated with additional game play. Such benefits data may be analyzed, for example, to spot trends and/or to make improvements. For example, bonus-round only data may be analyzed to determine whether changes should be made concerning the manner in which offers for benefits such as additional game play should be made to certain players. In addition, in some embodiments, regulators and/or casino personnel, for example, may be able to access the benefits data and use it for various purposes, such as checking to ensure that the offers are being implemented in a manner that is consistent and that is fair to all players.

Before describing the details associated with such benefits offers, and/or "bonus-round only" operation, presented below are descriptions of illustrative apparatus and related components.

1. Electronic Gaming Device (GD) Components

FIG. 1A is a plan view of an embodiment 10 of an electronic gaming device (GD). In this example, the GD 10 comprises a three-reel slot machine that includes a display area 12 in which an outcome for a game of the slot machine is displayed to the player. The display area 12 may be, for example, a video display that displays simulations of reels. The display area 12 may be, in another example, a transparent window behind which is located mechanical reels. A payline 14 appears within the display area 12, and the payline is used to determine the outcome of a game. In particular, a particular set of symbols displayed along a payline of a reeled slot machine may be determinative of a winning or losing combination. As shown in FIG. 1A, two bells and an orange are displayed along the payline 14 and a message appears in display area 22 informing the player to place a wager in order to spin again. In some GD embodiments, multiple paylines (not shown) may be provided that may be horizontal (such as payline 14), vertical, and/or diagonal.

Slot machine 10 further comprises a handle 16. A player may initiate the movement of the reels in display area 12 to generate a game outcome by pulling on the handle 16. Alternatively, a player may initiate the movement of the reels in display area 12 by actuating the "START" button 18. When a player utilizes the GD in a regular mode of operation, he may place a bet by using the "BET 3 COINS; MAX BET" button 13, or the "BET 2 COINS" button 15, or the "BET 1 COIN" button 17" before utilizing the handle 16 or START button 18 to initiate play (In some embodiments, the GD may include additional and/or alternate types of buttons, for example, an "INCREASE BET" button and/or a "DECREASE BET" button operable to either increase or reduce the size of the bet). Any or all of handle 16, START button 18, BET 3 COINS; MAX BET button 13, BET 2 COINS button 15, and the BET 1 COIN button 17 are exemplary embodiments of an input device of the GD.

In this exemplary implementation, the slot machine 10 also comprises a player tracking device 20 that includes a player tracking card reader and a display (e.g., an LED display) for outputting information related to the player identifier (e.g., player's name and number of comp points associated with that player's account). The player tracking device 20 may be configured to read, for example, a magnetic stripe found on the reverse side of a player gaming card provided by a casino, and to write information thereto. In some embodiments, the player tracking device 20 may be configured to communicate with a smart card or other types of cards that may include storage means for storing player data and the like.

An additional component of slot machine 10 is another display area 22 that may be used to display information to a player. The display area 22 may be utilized, for example, to display text or graphics informing a player that he is eligible for a benefit such as one or more additional game plays at a second GD, and/or to display a message to the player that he has qualified for a bonus, and/or to convey other information to the player.

A payment system 30 includes a bill acceptor and credit card reader 34, and a coin acceptor 36. Other payment systems, such as ticket or coupon acceptors, and/or a smart card reader, could also be utilized. A player utilizes the payment system 30 to provide payment to obtain wagering credits so that the player may make a wager for playing a game.

The slot machine 10 further comprises a credit meter balance 35 that reflects the amount of electronic credits currently available to a player (as shown in FIG. 1A, the player has 156 credits available). The player may use the electronic credits as wagers for games played on the gaming device. In some embodiments, electronic credits may be "cashed out" as coins, bills, tokens, a cashless gaming receipt, and/or value transferred to another financial account associated with the player.

The slot machine 10 includes yet another display area 40, which displays a regular mode payout schedule for the slot machine 10. The payout schedule displays payouts that correspond to various outcomes obtainable during the regular mode of operation of the slot machine 10. In one or more embodiments, if an outcome is displayed in display area 12 that, as indicated in display area 40, corresponds to a payout, the credit meter balance 35 may be increased by an amount of electronic credits corresponding to the payout. In some embodiments, an alternate payout schedule, such as a bonus-round payout schedule (not shown), may also be displayed in the display area 40 or elsewhere, which may indicate the payouts available when a player is eligible for receiving such a benefit.

Finally, the slot machine 10 comprises a coin tray 50 into which payment to the player may be rendered by dispensing coins. Such coins may be dispensed based on, for example, a player's indication that the player would like to cash out his credit meter balance and/or after a winning outcome obtained by a player as a result of playing a game on the slot machine 10.

Figure 1B:
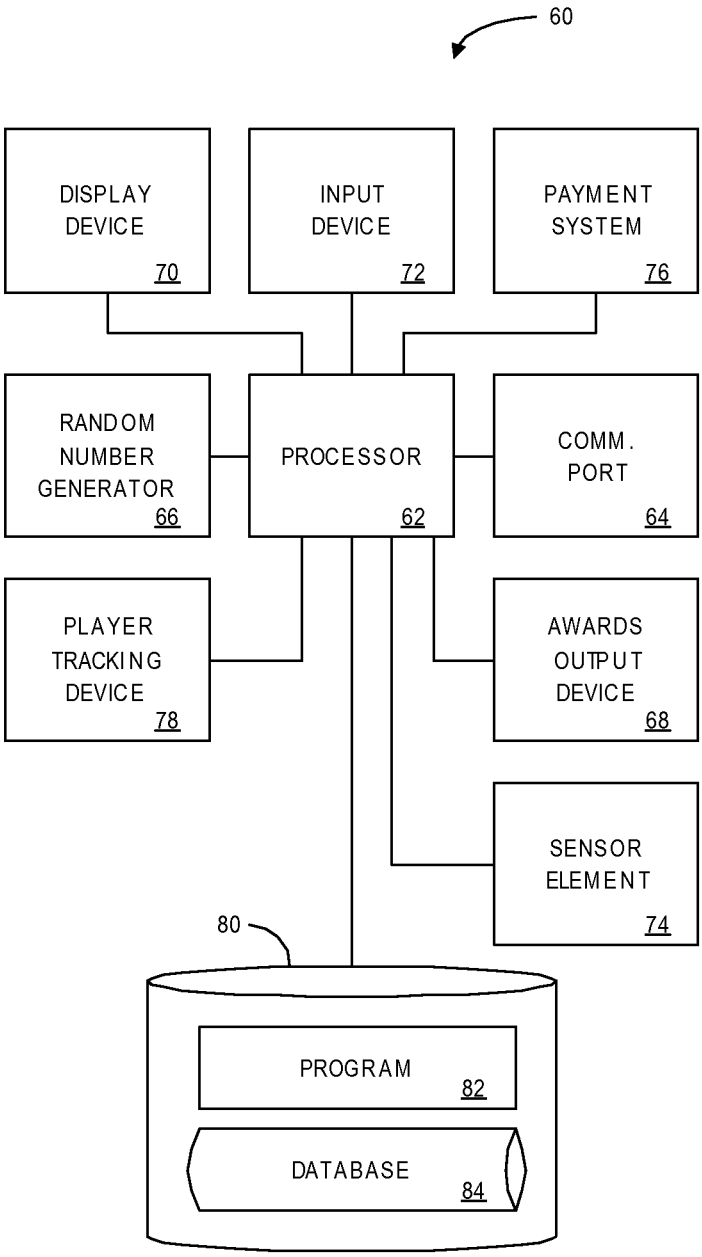
FIG. 1B is a simplified block diagram of an embodiment of a GD similar to that depicted in FIG. 1A.

FIG. 1B is a block diagram 60 of an embodiment of a GD or player terminal which may be similar to that of FIG. 1A. The GD 60 may be implemented as a system controller, a dedicated hardware circuit, an appropriately programmed general-purpose computer, or any other equivalent electronic, mechanical or electromechanical device. The GD 60 may comprise a game of skill or a game of chance, for example, a reeled slot machine (whether mechanical or video), a video poker terminal, a video blackjack terminal, a video keno terminal, a video lottery terminal, a pachinko machine, or any apparatus that provides an electronic version of any tabletop game. In various embodiments, an GD may comprise, for example, a personal computer (e.g., which communicates with an online casino Web site), a telephone (e.g., to communicate with an automated sports book that provides gaming services), or a portable handheld gaming device (e.g., a personal digital assistant (PDA), Nintendo GameBoy™, or SONY brand PSP™). In some embodiments, a user device such as a PDA or cell phone may be used in place of, or in addition to, some or all of the GD 60 components depicted in FIG. 1B.

The GD 60 of FIG. 1B includes a processor 62, such as one or more Intel® Pentium® processors, or similar processors manufactured by other companies such as Advanced Micro Devices, Incorporated. The processor 62 is in communication with a memory 80 and a communication port 64 (e.g., for communicating with one or more other devices, such as with a peripheral device). The memory 80 may comprise an appropriate combination of magnetic, optical and/or semiconductor memory, and may include, for example, Random Access Memory (RAM), Read Only Memory (ROM), a compact disc and/or a hard disk. The memory 80 may comprise or include any type of computer-readable medium. The processor 62 and the memory 80 may each be, for example: (i) located entirely within a single computer or other device; or (ii) connected to each other by a remote communication medium, such as a serial port cable, telephone line or radio frequency transceiver. In one embodiment, the GD 60 may comprise one or more devices that are connected to a remote server computer, such as a GS, which may be a casino server, for maintaining databases or data in another memory scheme.

The memory 80 stores a program 82 for controlling the processor 62. The processor 62 performs instructions of the program 82, and thereby operates in accordance with embodiments of the present invention, and particularly in accordance with the methods described in detail herein. For example, in some embodiments, the program 82 also includes instructions operable to provide an offer to a player to obtain at least one benefit that is associated with an award value. The program 82, as well as any other program for controlling a processor described herein, may be stored in a compressed, uncompiled and/or encrypted format. The program 82 furthermore includes program elements that may be necessary, such as an operating system, a database management system and "device drivers" for allowing the processor 62 to interface with one or more computer peripheral devices. Appropriate program elements are known to those skilled in the art, and need not be described in detail herein.

According to an embodiment, the instructions of the program 82 may be read into a main memory from another computer-readable medium, such from a ROM to RAM. Execution of sequences of the instructions in program 82 may cause processor 62 to perform one or more process steps described herein. In alternate embodiments, hard wired circuitry may be used in place of, or in combination with, software instructions for implementation of some or all of the processes of the present invention. Thus, embodiments described herein are not limited to any specific combination of hardware and software.

The memory 80 may also store one or more databases 84, or portions thereof. For example, the database 84 of memory 80 may include one or more probability databases, one or more payout databases, and one or more benefits databases. Thus, the memory 80 of the GD 60 may be configured to provide at least some of the data required for a player to play a game of chance, and/or to determine if a player qualifies to receive an offer for a benefit, and the GD may then obtain any other required software, data, and/or instructions from one or more other devices.

The fields of a probability database may specify, for example: (i) a random number (or range of random numbers) that may be generated by a random number generator; and (ii) an outcome that indicates the one or more indicia comprising the outcome that corresponds to the random number of a particular record. A GD 60 may utilize a probability database to determine, for example, what outcome corresponds to a random number generated by a random number generator and to display the determined outcome. For example, the outcomes may comprise the three symbols to be displayed along the payline of a three-reel slot machine. Other arrangements of probability databases are possible. For example, the book "Winning At Slot Machines" by Jim Regan (Carol Publishing Group Edition, 19264) illustrates examples of payout and probability tables and how they may be derived. The entirety of this book is incorporated by reference herein for all purposes.

The fields of a payout database may specify, for example: (i) an outcome, which indicates the one or more indicia comprising a given outcome; and (ii) a payout that corresponds to each respective outcome. If GD 60 comprises an electronic version of a three-reel slot machine, for example, the outcomes may mirror those obtained on a three-reel slot machine so that, after determining the outcome for displaying on the GD display, the GD may access a payout database to determine whether that outcome is one of the outcomes stored as corresponding to a payout. If it is, the GD may provide the corresponding payout to the player via a benefit output device described herein. Other arrangements of payout databases are possible. For example, the book "Winning At Slot Machines" by Jim Regan (Carol Publishing Group Edition, 19264), previously incorporated by reference, illustrates many examples of payout and probability tables and how they may be derived. In some embodiments, a benefits payout database may be used to specify, for example: (i) one or more outcomes that includes a definition of which indicia comprise any/each of the predetermined outcomes; and (ii) an increased payout or prize award that corresponds to each respective outcome in, for example, a bonus-round only play mode.

The processor 62 is also operable to communicate with a random number generator 66, which may be a component of the GD 60 in some configurations or of an GS in some embodiments. The random number generator 66 (as well as any other random number generator described herein), in accordance with at least one embodiment, may generate data representing random or pseudo-random values (referred to as "random numbers" herein). The random number generator may generate a random number every predetermined unit of time (e.g., every second) or in response to an initiation of a game on the gaming device. The generated random numbers may be used as they are generated and/or stored for future use.

A random number generator, as used herein, may be embodied as a processor separate from but working in cooperation with processor 62. Alternatively, a random number generator may be embodied as an algorithm, program component, or software stored in the memory of a GD or on another device, such as on an GS, and used to generate a random number. Alternately, a GD owner or operator may obtain sets of random numbers that have been generated by another entity using known methods.

The processor 62 is also operable to communicate with an awards output device 68, which may be a component of GD 60. The awards output device 68 may comprise one or more devices for outputting an award to a player of the gaming device 60. For example, in one embodiment the GD 60 may provide coins and/or tokens and/or chips as an award. The GD 60 may also or alternately provide a receipt or other document on which there is printed an indication of an award and/or a benefit, such as a cashless gaming receipt that has printed thereon a monetary value redeemable for cash and/or a benefit offer having no monetary value but good for obtaining a benefit such as a free game play on a second GD. In such an embodiment the awards output device 68 may comprise a printing and document dispensing mechanism, to provide, for example, a ticket, coupon, or a cashless gaming voucher. In yet another example, the GD 60 may provide electronic credits that may be subsequently converted to coins and/or tokens. In yet another example, the GD 60 may credit a monetary amount to a financial account associated with a player, such as a credit card account, a debit account, a charge account, a checking account, and/or a casino account. In such an embodiment, the awards output device 68 may include a credit meter balance and/or a processor that manages the amount of electronic credits that is indicated on a display of a credit meter balance. In such an embodiment the awards output device 68 may comprise a device for communicating with a server on which the financial account is maintained. In some embodiments, the awards output device 68 may output a coupon or voucher that may be used to obtain a benefit, such as additional game play.

Note that, in one or more embodiments, the GD 60 may include more than one awards output device 68 even though only one awards output device is illustrated in FIG. 1B. For example, GD 60 may include both a hopper and hopper controller combination and a credit meter balance (See FIG. 1A). Such a GD may be operable to provide more than one type of payment or award to a player.

The processor 62 is also operable to communicate with a display device 70, which may be a component of GD 60. The display device 70 may comprise, for example, one or more display screens or areas for outputting information related to game play on the GD or to an offer for benefits. For example, a cathode raytube (CRT) monitor, liquid crystal display (LCD) screen, or light emitting diode (LED) screen may be used. In addition, the GD 60 may include more than one display device 70, for example, an LCD display for displaying electronic reels and a viewing window behind which are located mechanical reels so that the player can view rotation of the mechanical reels during game play. The display device 70 may also be operable to display one or more messages to a player, for example, an indication that the player has earned an offer for at least one benefit (i.e., a display of the offer for the benefit) that is associated with an award value, and that requires use of a second GD to redeem the benefit.

The processor 62 may also be in communication with one or more other devices besides the display device 70, for outputting information (e.g., to a player or another device). Such other one or more output devices may also be components of GD 60. Such other one or more output devices may include, for example, an audio speaker (e.g., to output a message to a player, in addition to or in lieu of such a message being output via a display device 70), an infra-red transmitter, a radio transmitter, an electric motor, a printer, a coupon or product dispenser, an infra-red port (e.g., for communicating with a second gaming device or a portable device of a player), a Braille computer monitor, and/or a coin or bill dispenser. Examples of common GD output devices include a cathode ray tube (CRT) monitor on a video poker machine, a bell on a gaming device (e.g., rings when a player wins), an LED display of a player's credit balance, and an LCD display of a personal digital assistant (PDA) for displaying keno numbers.

The processor 62 is also in communication with an input device 72, which is a device that is capable of receiving an input (e.g., from a player or another device) and which may be a component of GD 60. An input device may communicate with or be part of another device (e.g. a server, another GD, etc.). Some examples of input devices include: a bar-code scanner, a magnetic stripe reader, a computer keyboard or keypad, a computer mouse, a button (e.g., mechanical, electromechanical, or "soft", as in a portion of a touch-screen), a switch (e.g. a two position toggle switch that may be used to switch between, for example, different game types or modes of operation), a handle, a keypad, a touch-screen, a microphone and associated voice recognition unit (which may include voice recognition software), an infrared sensor, a voice recognition module, a biometric input device (i.e. a fingerprint or retinal scanner), a coin or bill acceptor, a sonic ranger, a computer port, a video camera, a motion detector, a digital camera, a network card, a universal serial bus (USB) port, a GPS receiver, a radio frequency identification (RFID) receiver, an RF receiver, a thermometer, a pressure sensor, an infrared port (e.g., for receiving communications from with a second gaming device or a another device such as a smart card or PDA of a player), a weight or pressure sensor (such as a weight scale), a motion sensor, and a global positioning system card, chip or sensor. Common GD input devices include a button or touch screen on an electronic video poker machine, a lever or handle connected to the GD, a magnetic stripe reader to read a player tracking card inserted into an GD, a touch screen for input of player selections during game play, and a coin and bill acceptor (see e.g., FIG. 1A). Input device 72 may comprise any of the above-described input devices or any combination thereof (i.e., input device 72 may comprise more than one input device).

The input device 72 may include an apparatus for determining if a player has qualified to receive a benefit, and the processor 62 may then provide an offer to obtain the benefit. Such an apparatus may include, for example, a counter that monitors, tracks and/or counts the number of nonwinning outcomes generated by the GD and then outputs a signal when the number of non-winning outcomes exceeds a predetermined threshold number. In some embodiments, an apparatus is provided that is operable to determine if the player is feeling frustrated, and configured to provide an output signal to the processor as an input for determining a trigger condition that may be used to identify the player and/or to offer a benefit to the player. For example, the device may include a play activator coupled to the processor, and a sensor coupled to the play activator and the processor, wherein the sensor is operable to generate a signal indicative of an amount of force that the player exerts on the play activator, and wherein the processor is operable to receive the signal and determine if the amount of force exceeds a predefined threshold amount of force. In some embodiment s, the input device 72 may be configured to communicate with a peripheral device, a smart card, a USB key device, a personal digital assistant, a handheld device, and a casino personnel device, and may be configured to permit access to the database 84 to obtain data.

In some embodiments, a GD 60 may comprise components capable of facilitating both input and output functions (i.e., input/output devices). For example, a touch-sensitive display screen is an input/output device (e.g., the device outputs graphics and receives selections from players). In another example, a processor may communicate with a "ticket-in/ticket-out" device configured to dispense and receive cash-out tickets. Such a device may also assist in (e.g., provide data so as to facilitate) various accounting functions (e.g., ticket validation and redemption).

Of course, as would be understood by one of ordinary skill in the art, a GD 60 may comprise various combinations of any or all of the component devices described herein. For example, in one or more embodiments, the GD may include more than one display device, one or more other output devices, several input devices, and so on (e.g., two display screens, two audio speakers, a headset, a ticket-in/ticket-out device and several buttons).

The processor 62 is also in communication with a payment system 76, which may be a component of the GD 60. The payment system 76 is a device capable of accepting payment from a player (e.g., a bet or initiation of a balance) and/or providing payment to a player (e.g., a payout). Payment is not limited to currency, but may also include other types of consideration, including products, services, and alternate currencies. Payment system 76 may be considered to be an example of an input device 72 in some embodiments.

Exemplary methods of accepting payment by the payment system 76 include (i) receiving hard currency (i.e., coins or bills), and accordingly the payment system 76 may comprise a coin or bill acceptor; (ii) receiving an alternate currency (e.g., a paper cashless gaming voucher, a cashout ticket, a coupon, a non-negotiable token), and accordingly the payment system 76 may comprise a bar code reader or other sensing means; (iii) receiving a payment identifier (e.g., a credit card number, a debit card number, a player tracking card number or other account identifier) and debiting the account identified by the payment identifier; and (iv) determining that a player has performed a value-added activity.

Processor 62 may also be in communication with a player tracking device 78, which may be a component of GD 60. Player tracking device 78 may, in some embodiments, be considered an example of an input device 72. Player tracking device 78 may, in one or more embodiments, comprise a reader device operable to read information from and/or write information to a card such as a smart card and/or a player tracking card, such that (i) players may be identified, and (ii) various data associated with players may then be determined. For example, previous wagering, coin-in and/or cash-out behaviors previously engaged in by the player, the number of promotional credits available to that player, and the number and types of offers for benefits, such as additional bonus-round only spins, may be determined based on information associated with the player identifier.

In one embodiment, the player tracking device 78 may comprise (i) a card reader (e.g., a port into which player tracking cards may be inserted), (ii) various input devices (e.g., a keypad, a touch-screen), (iii) various output devices (e.g., a small, full-color display screen), and/or (iv) combinations thereof (e.g., a touch-sensitive display screen that accommodates both input and output functions). Various commercially available devices may be suitable for such an application, such as the NextGen™ interactive player tracking panel manufactured by IGT or the iVIEW display screen manufactured by Bally® Gaming and Systems.

As known in the art, "smart cards" may incorporate (i) a memory, and (ii) means for accessing such a memory. For example, in an embodiment, the memory may store data related to aspects of the present invention. Data may be written to the smart card during game play, and various data may be updated on a continuous, or periodic, or event-triggered basis. Accordingly, in one or more embodiments one or more devices operable to carry out various processes of the present invention may have associated therewith a smart card reader device, such that data may be read from the smart card or loaded onto the smart card pursuant to the execution of such processes.

In one embodiment, GD 60 may be operable to facilitate downloadable games such that games available for play on GD 60 may be stored on a server device and downloaded to the GD 60. In one embodiment, software components of the GD 60 may be remotely accessed, modified and/or updated by another device. For example, payout or probability tables for the regular mode of game play, and for additional game play or bonus-round game play, may be stored in the memory of the GD 60, and may be accessed, altered, modified or updated remotely. In addition, hot fixes may be applied to software stored by the GD 60 and/or new versions of software may be downloaded to the GD 60. Similarly, the GD 60 may be programmed to retrieve any or all such updates from another device, as appropriate. Any of the above (e.g., accessing stored data, downloading of a game, updating of software, modification of a payout table or probability table) may occur, for example, based upon an occurrence of an event (e.g., a scheduled event, or a trigger event), and/or based on an indication being received from casino personnel or other personnel (e.g., a regulator). In an embodiment, GD 60 may be a thin client device that is controlled by one or more other devices.

In one or more embodiments, various aspects of the present invention may be practiced by replacing and/or augmenting one or more components (e.g., hardware and/or software components) of an existing GD. Thus, in one or more embodiments, the invention may be applied as a retrofit or upgrade to existing GDs currently available for play within various casinos.

In a specific example, a gaming device may comprise various electronic components mounted to one or more printed circuit boards (PCBs). Such components may include various hardware described herein, such as a communications port and various controllers of peripheral devices (e.g., a display controller), as well as a memory for storing programming instructions (software) and a processor for carrying out such instructions. One form of memory commonly found in GDs is electronically erasable programmable read-only memory or erasable programmable read-only memory (EEPROM or EPROM). Thus, in one or more embodiments, an EEPROM storing software with instructions for carrying out aspects of the present invention (as well as instructions for carrying out other functions traditionally performed by the GD) may replace or augment an EEPROM previously installed in a GD, such that the gaming device may be configured to operate in accordance with various processes described herein.

For example, a separate display device or LED meter, which may be used to display and/or determine when an offer for a benefit or benefits should be made, may be made available for purchase to various casino operators. Such components which may comprise various hardware and software (e.g., an EEPROM storing software instructions), may be installed in and/or retrofit to an existing device such as a GD (e.g., a video-reel slot machine, a video poker machine, etc.). In some embodiments, when the separate display device and/or LED meter is installed (and/or retrofitted), offers for benefits may be made to a player based on the various gaming outcomes generated by that player, and/or each of such "secondary machine benefits" may be tracked. In an embodiment, the player may be required to input payment of a nominal fee in order to receive an offer for benefits.

In some embodiments, rather than configure existing GDs to execute embodiments described herein by installing or connecting new hardware and/or software, software may be downloaded into an existing memory of one or more GDs. U.S. Pat. No. 6,805,634 to Wells et al. teaches methods for downloading data to gaming devices in such a manner. The entirety of U.S. Pat. No. 6,805,634 is incorporated by reference herein for all purposes. Thus, in some embodiments, an existing GD may be reprogrammed to accommodate new functionality of the present invention without the need, or by minimizing the need, to remove and replace hardware within the GD.

2. Electronic Game Server (GS) Components

Figure 2:
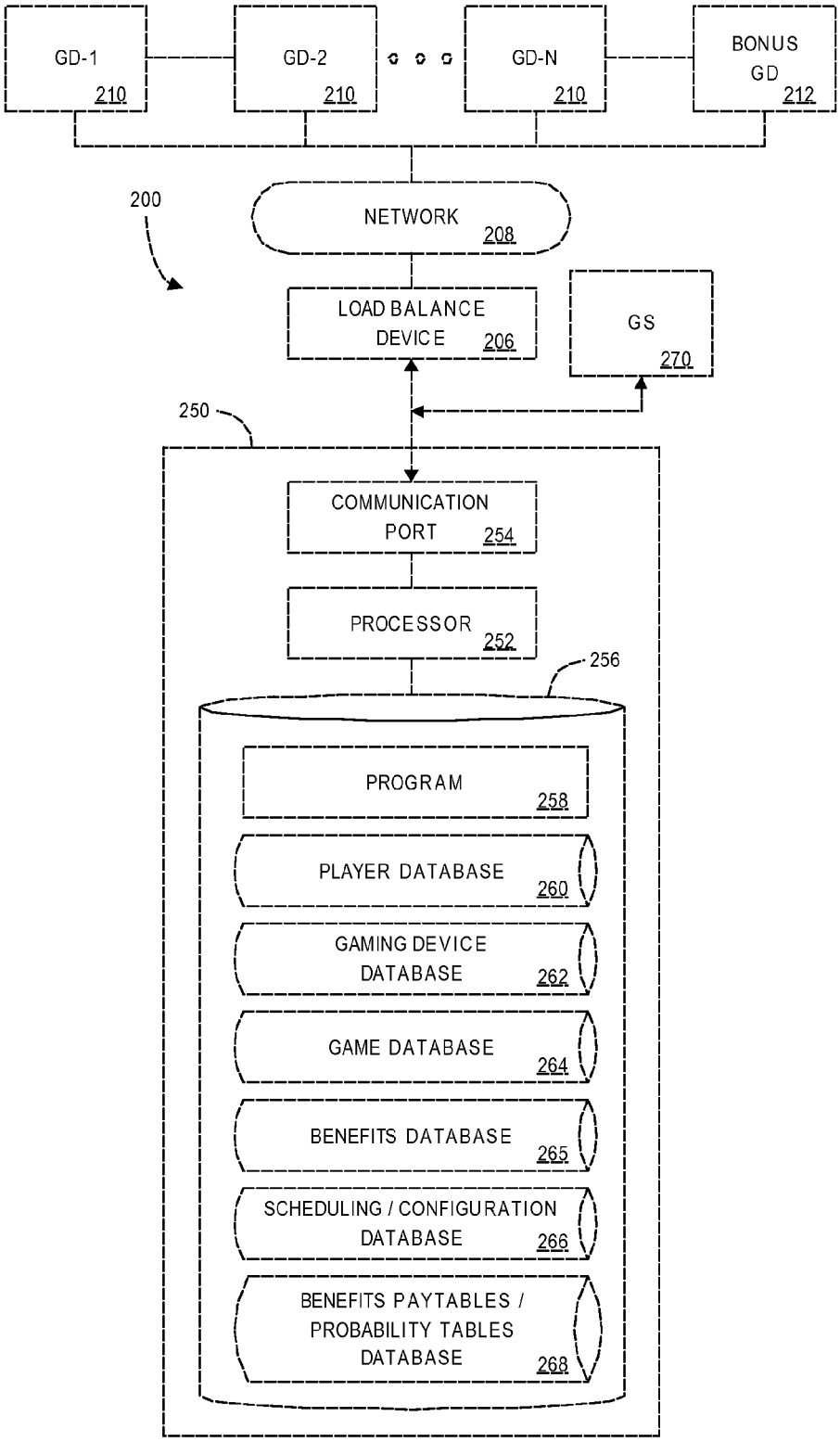
FIG. 2 is a block diagram of an embodiment of an electronic Game Server (GS) in accordance with the invention, wherein the GS is a component of a system and may be configured to communicate with a plurality of GDs.

FIG. 2 illustrates an example of a system 200 that includes an embodiment of an Electronic Game Server (GS) 250 configured to communicate, through a Load Balance Device 206 and communications network 208, with a plurality of GDs 210 and a "Bonus" GD 212. A second GS 270 is also shown in communication with the plurality of GDs 210 and Bonus GD 212 through the Load Balance Device 206 and communications network 208. It should be understood, however, that only one GS or more than two GS's could be used, and that more than one Bonus GD 212 could be used, and thus that the network configuration depicted in FIG. 2 is provided for illustrative purposes only. In addition, although FIG. 2 indicates that there may be any number of GDs (GD-1, GD-2 to GD-N) and a Bonus GD 212, in any particular system configuration including the embodiment shown having two GS's, there will exist a threshold maximum number of GDs 210 and/or Bonus GDs 212 that could be handled to ensure that the system functions efficiently.

The GS 250 includes a processor 252, such as one or more Intel® Pentium® processors. The processor 252 is in communication with a communication port 254 for communicating with one or more other devices, such as the Load Balance Device 206, and a memory 256. The memory 256 may comprise an appropriate combination of magnetic, optical and/or semiconductor memory, and may include, for example, Random Access Memory (RAM), Read Only Memory (ROM), a compact disc and/or a hard disk. The processor 252 and the memory 256 may each be, for example: (i) located entirely within a single computer or other device; or (ii) connected to each other by a remote communication medium, such as an Ethernet cable, telephone line or radio frequency transceiver. In one embodiment, the GS 250 may comprise one or more devices that are connected to a separate, remote server computer or computers for maintaining databases.

The memory 256 stores a program 258 for controlling the processor 252. The processor 252 performs instructions of the program 258, and thereby operates in accordance with at least some embodiments of the present invention, and particularly in accordance with the methods described in detail herein. The program 258 may be stored in a compressed, uncompiled and/or encrypted format. The program 258 furthermore includes program elements that may be necessary, such as an operating system, a database management system and "device drivers" for allowing the processor 252 to interface with one or more peripheral devices. Appropriate program elements are known to those skilled in the art, and need not be described in detail herein. The program 258 may include computer program code that allows the GS 250 to employ the communication port 254 to communicate with one or more GDs 210 and one or more bonus-round only GDs 212.

According to an embodiment, the instructions of the program 258 may be read into a main memory from another computer-readable medium, such as from a ROM to a RAM. Execution of sequences of the instructions in program 258 may cause processor 252 to perform some or all of the process steps described herein. In alternate embodiments, hard wired circuitry may be used in place of, or in combination with, software instructions for implementation of the processes of the present invention. Thus, embodiments of the present invention are not limited to any specific combination of hardware and software. For example, in some embodiments, a peripheral device may be provided for storing benefits data that can only be accessed by authorized personnel, such as by a regulator and/or by a designated casino employee.

In an embodiment, the GS 250 functions to provide one or more parameters for downloadable games playable on one or more GDs 210, and may also provide data and/or payments to provide bonus game play on one or more second GDs 212. Accordingly, as shown in FIG. 2, the memory 256 may also store: (i) a player database 260, (ii) a gaming device database 262 that stores information related to one or more gaming devices with which the controller 250 is operable to communicate, which may include the Bonus GD 212, (iii) a game database 264 that stores information regarding one or more games playable on and/or downloadable to one or more gaming devices, (iv) a benefits database 265, (v) a scheduling and/or configuration database 266 useful for determining which games are to be made available on which gaming devices, and/or (vi) a benefits paytables and/or probability tables database 268.

The player database 260 may include, for example, data corresponding to a player identifier, player preferences, an indication of wagers placed or number of games played by a player, an indication of duration of play by a player at the GD, and the like. The benefits database 265 may include, for example, data associated with offers that may be made to players to obtain benefits. The benefits data may include, for example, criteria that governs how and when offers are made to players for obtaining such benefits as additional game play or bonus-round only game play on one or more Bonus GDs in the network, which will be discussed in more detail below. The Benefits Paytables and/or Probability Tables database 268 may include, for example, data concerning the paytables and/or probability tables for use when a player redeems benefits that were offered to him, which will be discussed in more detail below. Additional databases that store similar or different data could be included in the memory 256, and thus the particular configuration depicted in FIG. 2 is for exemplary purposes only. In addition, some of the information stored in the various databases may also be stored in a memory associated with or physically located at one or more of the GDs. Further, one or more of the databases may contain data that is the same as, or overlaps with, data stored in another database.

Similarly, in one embodiment the GS 250 may be operable to configure one or more GDs 210 or the Bonus GD 212 remotely, update software that may be stored on a GD and/or to download software or software components to a GD. For example, GS 250 may be operable to apply a hot fix to software stored on a GD 210, modify a payout and/or probability table stored on a GD or stored on the Bonus GD 212, and/or transmit a new version of software and/or a software component to a GD 210 or the GD 212. GS 250 may be programmed to perform any or all of the above functions based on, for example, an occurrence of an event (e.g., a scheduled event), receiving an indication from a qualified casino employee and/or other person (e.g., a regulator), and/or when receiving a request from a player.

Although the databases 260 through 268 are described as being stored in a memory of GS 250, in other embodiments some or all of these databases may be partially or wholly stored, in lieu of or in addition to being stored in a memory of controller 250, in a memory of one or more other devices. Such one or more other devices may comprise, for example, one or more peripheral devices, one or more GDs, a slot server (if different from the GS 250), another electronic gaming server (such as GS 270) or different type of application server, another device, or a combination thereof. Further, some or all of the data described as being stored in the memory 256 may be partially or wholly stored (in addition to or in lieu of being stored in the memory 256) in a memory of one or more other devices. Such one or more other devices may comprise, for example, one or more peripheral devices, one or more gaming devices, a slot server (if different from GS 250), another type of electronic gaming server or application server, another device, or a combination thereof Thus, any or all of the devices in the system 200 may store one or more programs for executing one or more steps of the processes disclosed herein, and may maintain one or more databases that contain data that may be useful to execute one or more steps of the processes described herein.

For example, in an embodiment a particular GS such as GS 250 may be designated as a "Benefits Server" and function to obtain and store GD benefits game requests (i.e., to generate outcomes for a particular type of bonus game GD, and/or to provide offers for benefits, and the like), responses, outcomes and/or other data that concern a GD 210 and/or a Bonus GD 212, or a group of GDs and the Bonus GD 212, or an entire system of GDs and one or more Bonus GDs. In an embodiment, the Benefits Server may be operable to obtain and store various data of a group of GDs that may be configured to provide bonus game play, for example, that are all in one physical location, such as a gaming floor of a casino, or in a lounge area of a hotel or restaurant, or in an airport lounge. In some embodiments, one or more GS's may function to obtain and store data of GDs in disparate locations that may be owned by different entities. It is also contemplated that one or more servers may function to automatically analyze a portion or portions of the data gathered from the GDs, which may include benefits data, concerning any particular GD or group of GDs (as described in more detail below). In addition, one or more of the GS's of a system may be a secure computer that can only be accessed by a regulator, or authorized casino personnel, or other authorized person. Accordingly, to access any of the databases of a secure GS, input of security codes, such as one or more password, may be required. It is also contemplated that additional security measures would be implemented, such as firewall programs to prevent unauthorized persons from viewing and/or modifying the data gathered therein. In some embodiments, a GS may be a Web Server.

Thus, in some embodiments, a system 200 for providing gaming and benefits to players may include a plurality of electronic game devices 210 and a Bonus GD 212, wherein at least one of the GDs is configured to provide an offer or offers for benefits, such as additional game play on the Bonus GD. Such a network system may also include at least one server, such as the GS 250, configured to communicate with the plurality of GDs 210 and the Bonus GD 212, and to receive benefits data. The GS 250 may be configured to obtain and to store the benefits data in a benefits database 265, wherein the benefits data may include data identifying the GD that is operating, data identifying all other communicating devices associated with that GD, data associated with at least one offer for benefits, data corresponding to the time and date of each such offer, player identification data, and/or any other types of data associated with benefit offers. In some embodiments, a GS includes at least one memory and is configured to automatically analyze the benefits data and to generate output, which may be a report and/or one or more instructions for taking at least one action, based on the analysis.

3. Benefit Offers and Providing Benefits

A. Offers for Benefits

Figure 3A:
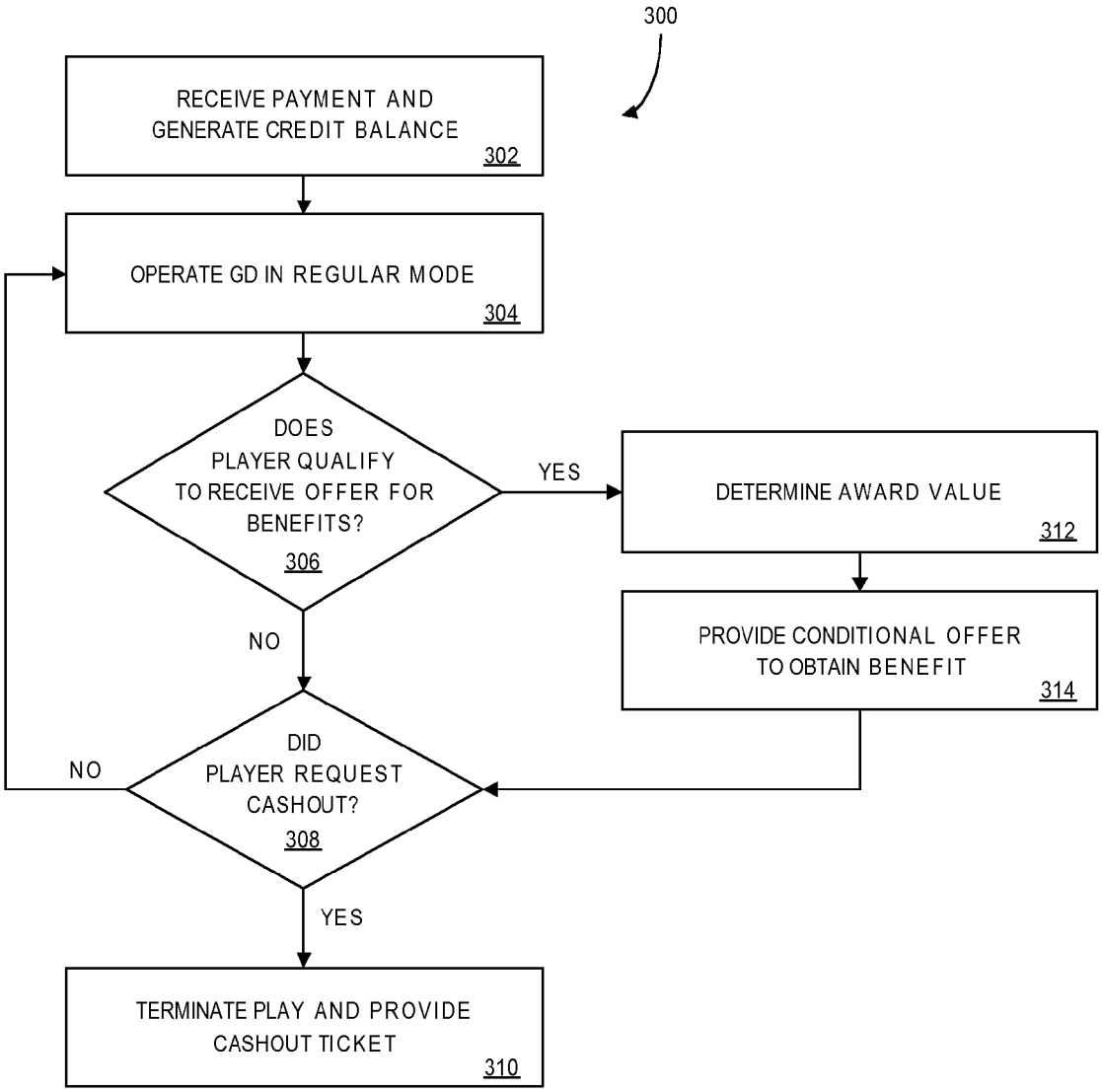
FIG. 3A is a flowchart illustrating the operation of a GD to determine if a player qualifies to receive an offer for a benefit in accordance with an embodiment of the invention.

FIG. 3A is a flowchart 300 illustrating an embodiment of the operation of a GD that is configured to provide offers for benefits to players. The GD may be part of a gaming system, such as the network system 200 shown in FIG. 2, or may be a stand-alone GD. Thus, as discussed above, the GD may be one of a plurality of GDs that may be in communication with other GDs, GS's, and/or other devices, which may be configured in a thin-client architecture. A player initiates game play at a particular GD by making a payment and obtaining a credit balance.

Referring again to FIG. 3A, in step 302, a GD receives payment (or some form of consideration) and establishes a credit balance for the player. The GD may include a payment system (for example, the payment system 30 of FIG. 1A) in order to accept the payments from players. The player can then use the credit balance to place bets and initiate wagering game play. The GD may be, for example, a video poker machine. In step 304, the GD operates in a regular mode, requiring the player to place a wager (i.e., make a bet) before he is permitted to push a button to request, for example, five cards to be dealt. The dealing task for the game may be handled by some other device (for example, the GD is a video five card stud gaming machine, and cannot itself generate the information). An example of a request parameter in this case is "five-card stud", which entails requesting five random numbers, and as explained earlier, such a request may be handled by another device, for example, by a GS. The five random numbers are then mapped to cards, and this function may be handled by an GS that is different from, or the same as, the GS that generated the random numbers. The results are transmitted back to the requesting GD, which then uses the information to display the cards on a video screen to the player, and to provide credits if a winning outcome was generated. Some or all of the data concerning this operation may be stored as transaction data in a database, and may also be stored in one or more additional databases.

Next, a determination 306 is made as to whether the player qualifies to receive an offer for one or more benefits. If not, then the process checks to see if the player made a request to cashout 308, and if the player did so then the GD terminates play, and in this example, provides a cashout ticket 310. In some embodiments, the cashout ticket is provided only if there is a positive remaining credit balance and/or if an offer for at least one benefit was made to the player. If the player did not request a cashout, then the process branches back to step 304 wherein the GD continues to operate in the regular mode to provide the wagering game to the player.

But if the player does qualify to receive an offer for benefits 306, then an award value is determined 312 and a conditional offer to obtain a benefit 314 is made to the player (for example, a condition may be that the player must use a second GD to obtain the benefit). In some embodiments, at least a portion of the conditional offer is made in association with an expected value (EV), which may be predetermined or may be based on certain considerations, which will be described in detail below. A display (not shown) associated with the first GD may output an indication, such as a text or audio message, to the player to inform him that he qualifies for benefits. Next, the process checks to see if the player has made a request to cash out 308. If so, then a cashout ticket, or some other type of ticket or voucher, is printed 310 and game play is terminated. The cashout ticket may include a readable and/or an encoded indication of the offer for the benefits, and may also include a readable and/or encoded indication of the payout amount. Such a cashout ticket may also include the name or number of the second GD, and a map or other indication of where the second GD is located, for example, in the casino, and/or in relation to the first GD. However, if the player did not request a payout in step 308, then the GD continues to operate in regular mode 304.

B. Types of Benefits

Various types of benefits may be offered to players. For example, a player may be offered further game play on a second GD that is different from the GD that he is currently playing, and/or that is in a remote location, or that is centrally located on the slot floor of a casino. For example, machine A awards a player with free or reduced-cost game play on Machine B, which may include an offer such as one free spin on the "Big Bonus Wheel", or one free spin on a standard Slot Machine B (which may be located in a central location on the slot floor, or may be located in a different GD room of a casino). Other examples may include an offer for one bonus round entry, 3 minutes of free play on Machine B wherein the player can collect any winnings over 20 coins, non-cashable credits added to the meter of Machine B (wherein such credits must be wagered with on Machine B before they can be cashed out), one extra payline for any payline being wagered on while using Machine B (which may include an added restriction, such as only up to 20 coins), one extra coin bet for every coin bet while using Machine B (which may include an added restriction, such as only up to 20 coins).

The offer to obtain a benefit may be couched as a "mystery prize", for example, the player may be offered a spin/bonus round assuring at least a minimum value at the second GD.

For example, the first GD may display the offer as: "You've won a mystery bonus! To claim it, visit Machine B" (which will then randomly determine the prize, perhaps by using a certain predetermined paytable, as will be described below). In another example, while playing Machine A, the player is offered a benefit of five spins on Machine B, but doesn't know until he visits Machine B what "type" of spins they are. In other words, when the player visits Machine B to redeem the benefit, he learns that one or more of the following parameters associated with the additional spins are in effect: (i) predetermined wager amounts; (ii) pre-selected denominations; (iii) one or more paytables. For example, of the five spins, three might be "silver" level spins, which may provide a payout having a lower jackpot then two "gold" level spins, and two might involve wager amounts of five credits each that are provided along with a standard paytable for that type of game.

The player may also be offered a monetary payout. For example, Machine A may award a player a payout that is redeemable on Machine B, which may be a fixed payout such as redeeming 25 coins at Machine B. Alternately, the offer may be a cashable 20 coins at Machine A, or 20 cashable coins and 5 non-cashable coins or credits (i.e., credits that must be used for wagering before they are cashed out) at Machine B. The offer may also comprise a variable payout. For example, the player may redeem between 10 and 50 coins at Machine B, and the offer may be displayed as "Congratulations! You've won a payout between 10 and 50 coins". In this example, the amount of coins paid to the player may be based on an expected value (EV), which will be explained below, and the EV could be determined by Machine B or by some other device.

The player may also be offered a "perceived" variable and/or mystery payout. For example, a payout can be determined by Machine A and not specifically revealed to the player until he utilizes Machine B.

The offer for a benefit may also comprise one or more game play modifications, or an award of special game play features. For example, Machine A may provide an offer to the player to obtain a feature of Machine B (or Table Game A) that the may have otherwise been unavailable, restricted, or require a fee. In another example, the player may be offered a probability table modification wherein the probability of achieving one or more game outcomes using Machine B may be favorably modified (e.g., it is now 5% more likely that the player will hit Machine B's jackpot). Another example could be increasing the probability of achieving a "Jackpot" symbol on a third reel, or adding an extra "wild" card to a deck. In another example, the player may be offered a payout modification. For example, "Bar-Bar-Bar" of Machine B will pay an extra 25 coins. The player may also be offered a game resource and/or indicia that may improve the players' odds for obtaining winning outcomes. For example, the player may be offered use of a "wild" card or symbol to use at any time in the main game, or a "hammer" resource to "nudge" or realign slot reels post-outcome, or one free lemon symbol (e.g., if player is able to collect four more to achieve a total of five, a payout is awarded), or a "Key" resource that may be used to unlock a payout and/or a "treasure" that the player may win randomly at a second GD.

In some embodiments, the offer may include various other types of benefits. For example, the player may be offered additional comp points and/or an increased rate of earning comp points at a second GD. The player may also be offered "Loss Insurance", which could mean, for example, that 50% of the losses on the first 10 spins of a GD will be reimbursed. The player may also be offered multimedia options, for example, the player is granted access to "one free song" of his choice that may be downloaded an iPod® or to an MP3 player, or that could be played through directional audio speakers and/or hypersonic sound speakers that are components of a GD.

In some embodiments, the benefit offered at the first GD may be won simultaneously at a second GD. For example, when playing a first GD, Machine A, if the player achieves "Bar+1-Bar+1-Bar+1," the player is granted a payout for "Bar-Bar-Bar" at Machine A, as well as a bonus spin at a second GD, Machine B. The method may also include a "Press Your Luck" payout at the first GD, where, for example, the player wins a payout at the first GD, and then has the option to "collect" the payout or "press his luck" and risk it at a second GD for a potentially larger payout. For example, the offer displayed to the player may recite: "Collect 50 coins now, or risk it all at Machine B for a mystery payout instead! Win up to 10,000 coins!" In another example, the offer may read: "You've won a bonus round entry! You can play it now on this machine, or bank it and play it later on any machine. Which would you like to do?"

C. Receiving an Identifier at a Second GD

Figure 3B:
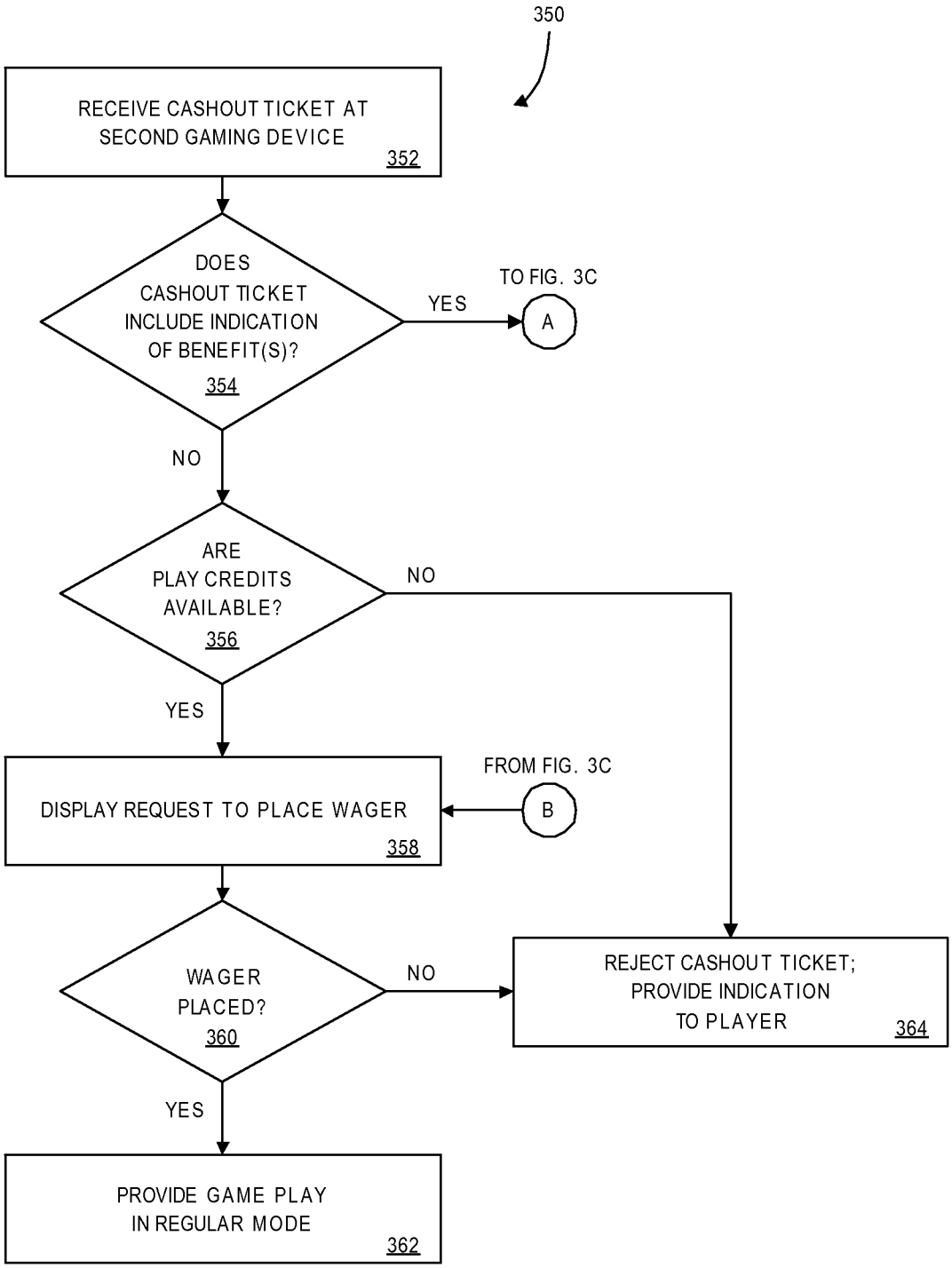
FIGS. 3B and 3C depict a flowchart 350 illustrating the operation of a second GD that is configured to receive cashout tickets from players and to satisfy proper requests to redeem benefit offers made by a first GD in accordance with an embodiment of the invention.
Figure 3C:
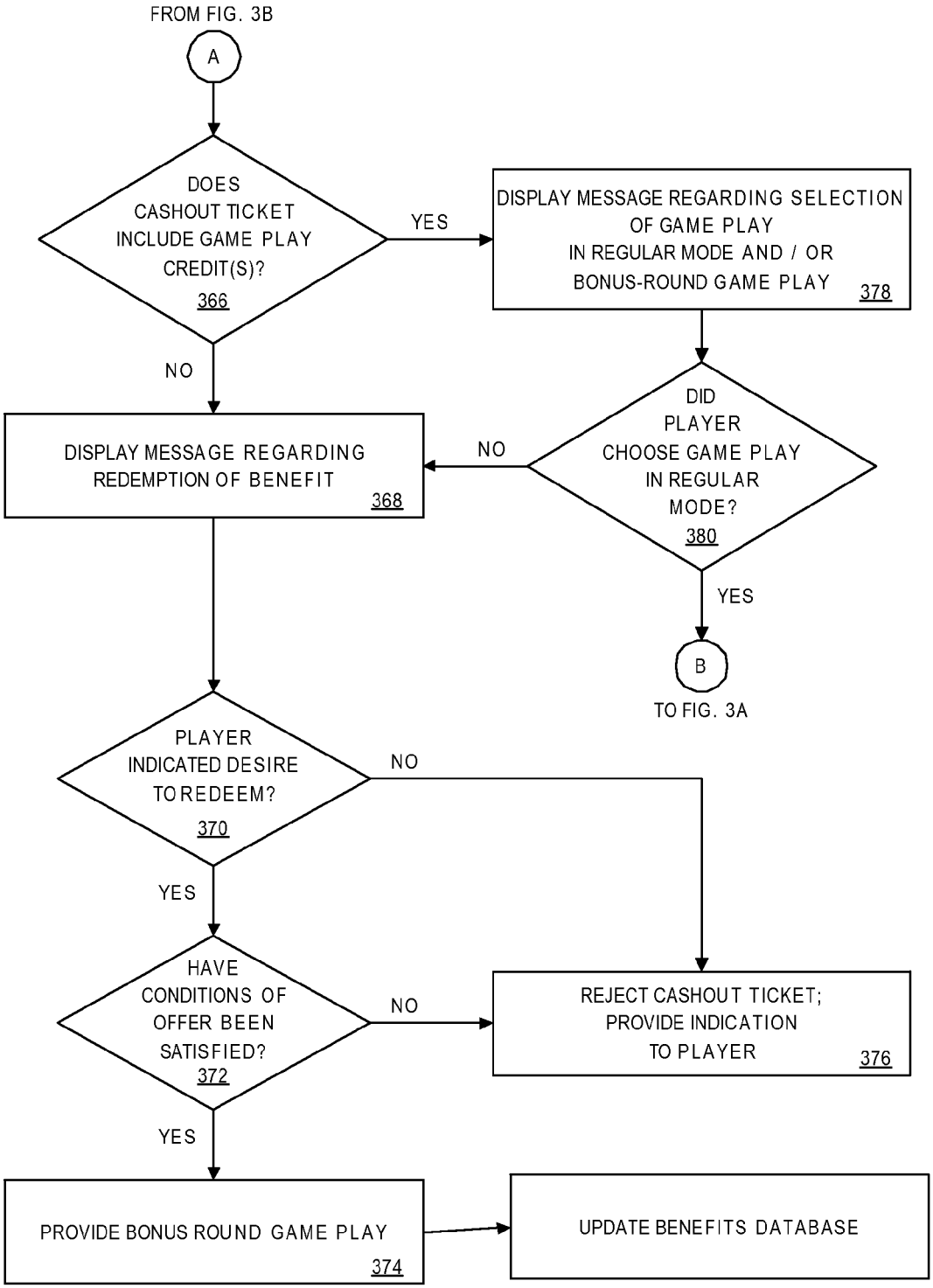

FIGS. 3B and 3C together depict a flowchart 350 illustrating an embodiment of a method for operating a second GD that is configured to provide a benefit to a player. In this example, the second GD includes a component or components operable to receive one or more identifiers, such as a cashout ticket, voucher, RFID chip, customized coin, token, biometric indicator and the like, from players and to satisfy proper requests to redeem benefit offers made by a first GD. A proper request may include the insertion of a valid cashout ticket, a player tracking card, a smart card, and/or providing other tangible media items or biometric indicators to verify the identity of the player and/or the authenticity of the cashout ticket. For example, the cashout ticket may include a barcode or other coded indicia that is scanned by a device associated with the second GD for certain security data. The use of various types of security indicia, such as using micro-printing to provide security code numbers on the cashout ticket, are known to those skilled in the art and will not be described in detail herein.

The second GD may be a bonus-round GD 212, for example, and may be part of the gaming system 200 shown in FIG. 2, or may be a stand-alone bonus-round only GD. The second GD may also be one of a plurality of second GDs that the player may have the option to use, and these GDs may be in communication with other GDs, GS's, and/or other devices, which may be configured in a thin-client architecture.

Referring to FIG. 3B, in step 352, the second GD receives a cashout ticket that a player inserts into a reader device and determines 354 if the cashout ticket includes an indication of at least one benefit. If not, then the second GD determines 356 if any game play credits are available, and if so requests 358 the player to place a wager. In step 360, the second GD determines if a wager has been placed, and if so operates 362 in a regular mode as described above with regard to FIG. 3A. If no game play credits are available in step 356, or if the player does not place a wager in step 360, then the cashout ticket is rejected 364 (i.e., by reversing a motor of the ticket reading device to drive the cashout ticket back out of a receiving slot), and the player is provided with an indication (i.e., a message on a display screen) of why the cashout ticket was rejected.

Referring again to step 354, if the cashout ticket includes an indication of a benefit that has been awarded to the player, then as shown in FIG. 3C, the second GD also determines 366 if the cashout ticket additionally includes game play credits.

If so, a message is displayed 378 to the player to select game play in the regular mode and/or bonus-round game play (i.e., redemption of the player benefit). (In some embodiments, the player may be permitted to choose to play only in regular mode, only in bonus-round game play mode, or to indicate that he would like to initially play in one mode followed by play in the other mode.) In this example, the second GD next determines 380 if the player selected game play in the regular mode, and if so, the process branches back to step 358 of FIG. 3B, wherein the player is asked to place a wager so that regular game play can commence. If the player did not chose regular game play in step 380, then the second GD displays 368 a message to the player regarding the redemption of benefits. If the player selects 370 to redeem his benefits (i.e., in this example, one or more spins of bonus-round game play), then the second GD determines 372 if any conditions included in the offer for bonus round game play have been satisfied (i.e., Is the player redeeming his benefit at an acceptable second GD?; Is the player redeeming at an appropriate time of day?; and the like conditions). If the conditions for bonus round game play have been satisfied, then the second GD provides 374 the bonus round game play due to the player, and updates 375 a benefits database. Such bonus round game play may include providing any prizes or payouts that the player earned and/or obtained by game play on the first GD.

If the player does not indicate a desire to redeem his bonus offer in step 370, or if one or more conditions of the offer have not been satisfied in step 372, then the second GD rejects 376 the cashout ticket and displays a message to the player concerning why bonus-round game play is not being provided.

In some embodiments, as mentioned above, if a player inserts a cashout ticket that indicates both game play credits and bonus-round game play credits, then the player may be permitted to operate the second GD in both modes. For example, the second GD may be configured to provide regular mode game play first, followed by bonus-round game play, or vice-versa. But it should be understood that in some embodiments, the second GD may only be configured to provide bonus-round game play.

In some embodiments, data concerning the request for redemption of benefits, and the provision of such benefits may be stored by the second GD or transmitted to another device for storage and/or for processing. For example, data concerning the type of, and the results of, bonus-round game play associated with a particular player may be transmitted to a casino server for storage in a database.

D. Gaming Results and Benefit Offers Database

FIGS. 4A and 4B illustrate a game results and benefit offers table 400 of a first GD, which is identified as GD-000001. The first GD may generate or obtain a random number between 1 and 10521 as shown in the Random Number (Range) column 402. In this example, the random numbers that are provided (FIG. 4A, column 402) are used to determine game play outcomes (see column 404) as read across in rows R400-1 to R400-14, and are also utilized to determine when a player is due to receive an offer for a benefit that is redeemable at a second GD. Thus, as shown in FIG. 4B, the game results table may also include data corresponding to outcome identifiers 406, redemption devices 408, and payouts 410.

For example, if the first GD generates or receives any random number between 1 and 8570, then as shown in row R400-1, that outcome is a non-winning combination (see column 404) and there is no payout (see FIG. 4B, column 410). But if a random number of 10332 is generated, for example, then as shown in row R400-6, the player achieves an outcome of "CHERRY-ANY-CHERRY" that is redeemed by the first GD (GD-000001; column 408) as a payout of 5 credits (column 410), and no benefits are offered to the player. If a random number of 10509 is generated, then as shown in row R400-11, the player achieves a "WHEEL-WHEEL-WHEEL" outcome and is due a payout of 40 credits (column 410), but must obtain that payout at a second GD (GD-000002; column 408). If the random number is 10517, then as shown in R400-12, the player is offered a SPIN (a game play) at a second GD labeled "Machine 3" (GD-000003).

If the random number is 10519, then as shown in R400-13, the player has achieved an outcome of "BONUS-BONUS-BONUS" and is due a bonus round of game play at any of a plurality of GDs (i.e., column 408 indicates that any of redemption devices GD-000004 to GD-000999 may be used). In this case, the bonus round yields an EV of 75 coins (column 410). The EV may be interpreted in this case to mean that the player has a 33% chance to achieve a payout of 50 coins, a 33% chance to achieve a payout of 75 coins, and a 33% chance to achieve a payout of 100 coins in a bonus round of gaming. In this example, a player may receive a cashout ticket that indicates an identifier for each of the possible second GDs where he can redeem this benefit (additional game play).

In another example, if the random number is 10521, as shown in R400-14, the player achieved an outcome of "BONUS2-BONUS2-BONUS2" and is thus due a bonus round play at any of a plurality of GDs (GD-000004 to GD-000999) that yields an EV of 150 coins (column 410). An EV of 150 may be interpreted to mean that the player has a 33% chance to achieve a payout of 100 coins, a 33% chance to achieve a payout of 150 coins, and a 33% chance to yield a payout of 200 coins in bonus-round only play.

E. Determining Whether to Offer a Benefit

A determination that a player of a first GD may be due a benefit redeemable at a second GD may be based partially or wholly on various non-random influences or non-random factors. For example, a player may qualify for a benefit based on such factors, to receive a benefit predetermined by a first GD that is redeemable by a second GD, receive a benefit redeemable by a second GD that is not known until the player visits the second GD, receive an increased likelihood of randomly being awarded a benefit by a first GD that is redeemable at a second GD (e.g., a combination of a random and a non-random factors). In an embodiment, a player may be playing against a "standard" paytable, until he "qualifies", based on one or more nonrandom factors, to play against the above paytable including game results that yield prizes redeemable by second GDs. For example, as described below, a player may achieve a certain status (e.g., a "gold" level of a loyalty program), such that various "second GD prizes" are added to the probability and/or game result tables of one or more GDs on which the player is playing and/or will play.

Non-random factors may include player status and/or player data. For example, a player may qualify for a benefit by wagering more than a certain amount (e.g., over a duration of time or number of game plays), by achieving a certain loyalty program status level (e.g., "gold tier"), by generating a threshold amount of theoretical wins, by executing a threshold number of game plays, by achieving a number of a certain type of outcomes (e.g., 10 consecutive losing outcomes, 15 winning outcomes in 30 minutes, etc.).

There may also be some time and date considerations that are factored in when trying to determine whether a player should be offered a benefit. For example, a player may qualify for a benefit only during a certain time of day (e.g., "off-peak" hours such as between 3 a.m. and 6 a.m.), only on certain days or dates (e.g., October 31$^{st}$, Tuesdays through Thursdays only, etc.).

In some embodiments, game utilization and capacity data may be used to determine whether or not to offer a benefit to a player. For example, a player may qualify for a benefit redeemable at Machine B (or Table Game A) based on "Second GD" factors such as: (i) if while playing Machine A it is determined that a utilization metric associated with Machine B is beneath a certain threshold, then offer the benefit; (ii) if while playing Machine A it is determined that a utilization metric associated with Machines A-Z is beneath a certain threshold (e.g., generally, traffic on the floor is light), then offer a benefit; (iii) if while playing Machine A it is determined that a utilization metric associated with Machines Q-Z is beneath a certain threshold (machines in room X, or machines of a particular bank, and any such subset), then offer a benefit. Such benefit offers may be determined by a GS, for example, that is in communication with a plurality of GDs and one or more bonus round GDs.

Determining whether to offer a player of a first GD a benefit redeemable at a second GD may include certain "first GD" factors. For example, if the first GD and/or GDs surrounding a first GD (e.g. in a bank of GDs located in a high-visibility area of a casino) are experiencing high utilization, players may be offered a benefit that directs them to other, lower traffic areas of the casino so that some of the "first" GDs which are located in the high visibility area will free up for other potential players.

In another example, a player may not qualify for a benefit if, while playing a first GD it is determined that a utilization metric associated with that first GD is above a certain threshold (e.g., the player's play on that first GD is profitable and should not be interrupted). Thus, certain utilization metrics may be considered when determining whether to offer a benefit to a player. For example, a binary valuation of whether or not a GD is currently being utilized, a ranking of utilization of one GD with respect to one or more other GDs, an amount of time a GD has been utilized within a certain period of time (e.g., four hours in the past day), a percentage of time a GD (or table game) has been utilized within a certain period of time (e.g., occupied 5% of the time in the past week), coin-in (e.g., more than a threshold amount of coins have been placed as wagers), theoretical win, and number and/or value of wagers per period of time (e.g., if there are over 10 pulls per minute on average at a bank of GDs, the system may inferentially determine that such GDs are experiencing high utilization). Consequently, in some embodiments, utilization and/or capacity factors may be considered such that, generally, (i) players are not directed to redeem benefits at second GDs or bonus-round GDs that are otherwise being utilized and/or are otherwise profitable, and/or (ii) players are not rewarded benefits when their play at "first" GDs is profitable.

In some embodiments, data concerning game performance, game history, and trends may be utilized when determining whether to offer a player a benefit. For example, a player may qualify for a benefit if while playing a first GD, it is determined that one or more second GDs are associated with various performance trends. For example, Machine B's performance may be considered to be "hot" (e.g., on a streak of payouts, and therefore may be perceived as "due" to payout in a player's mind) or "cold" (e.g., on a streak of losses, and therefore may be perceived as "due" to payout in a player's mind). A machine or game may be considered "hot" or "cold" based on such metrics as coins paid per unit time, the number of winning outcomes per unit time, the number of consecutive outcomes of a particular type (wins, losses), and the percentage of all wagers paid out as winnings (e.g., per unit time).

In some embodiments, a player "A" who has achieved one or more "winning" outcomes may be provided with benefits redeemable at a second GD that is situated next to another GD being used by player "B" who has not been winning, or who has suffered numerous losing outcomes. For example, player A goes to the second GD and inserts his cashout ticket obtained from the first GD, and is awarded with bonus-round game play that involves one or more winning outcomes. Player B, who is playing the GD next to the second GD, can observe that winning outcomes are possible, which may encourage player B to continue game play at his GD. Alternatively, player A, who has achieved one or more "winning" outcomes, may be required to obtain his benefits at a second GD that located away from player B, who has suffered loses, to avoid antagonizing or alienating player B. Such determinations may be made, for example, by utilizing and/or processing data of a player database, data of a benefits database, or some other data to optimize second GD usage with regard to winning players and/or with regard to losing players.

F. Limits on Benefits Offers

In some embodiments, certain restrictions or limits may be associated with the offer for, and the redemption of, the benefits. For example, a benefit may be redeemable only during certain time periods (e.g., before the end of the day, between 2 p.m. and 6 p.m., only on weekdays, etc.). In addition, the benefits may be gated or staggered. For example, if a player wins five free game plays on a second GD, Machine B, the player may be permitted to redeem one per hour for the next five hours. In another example, with respect to one or more particular second GDs, the benefits may only be redeemable at Machine B, or may be redeemable at any Machine B-Z (at any of a plurality of GDs of a certain type), or be redeemable at any GD in Room X, or be redeemable at any machine in Bank X, or may be redeemable at any Manufacturer X-type GD. Other limitations may also be in effect, such as the benefit may only be available up until a certain amount of credits have been won or otherwise provided (e.g., "up to 20 free wagers will be placed for you").

In some embodiments, various factors or rules may be considered when determining whether a player of a first GD is due a benefit redeemable at a second GD, such as at a Bonus-Round only GD. For example, a random determination may be made, wherein a first GD randomly determines that a player is due a benefit redeemable at a second GD, by generating a random number and comparing it to a predetermined game result table. (It should be understood, however, that another device, such as a GS may perform any or all of such random number generation, table storage, and/or other functions, and may also transmit data or instructions that are required to a second GD, for example.)

3. Storing Data Concerning Offers for Benefits

In some embodiments, an indication of a benefit may be stored, for example, in an electronic memory. For example, an electronic database (e.g., a "benefits due" database) may be utilized to store an indication that a determination has been made that a player is due a benefit. A gaming device, a server, a smart card, a portable handheld gaming device, a customized chip, and the like may store such data.

FIG. 5 illustrates an example of a benefits database 500 that may store data associated with benefits determinations. The benefits database includes columns for data associated with a player identifier 502, the "outcome" 504 that yielded the benefit, an outcome identifier 506, a list of one or more redemption devices 508 at which the benefit may be redeemed, and the benefits that are due 510. Not all of this data may be necessary in some embodiments (e.g., simply "outcome identifier" and "player ID" may suffice), whereas other embodiments may include all of this data plus other data that is not shown. In particular, in row R500-1, player P-000001 obtained a "Wheel-Wheel-Wheel" outcome on a first GD, which received outcome identifier O-000011 and is due a benefit of 40 credits at a second GD identified as GD-000002. In row R500-2, player P-0003541 obtained a "GD3-Spin, GD3 Spin, GD3 Spin" outcome on a first GD, which received outcome identifier O-000012 and is due a benefit of one free Spin at a second GD identified as GD-000003. In row R500-3, player P-023452 obtained a "BONUS-BONUS-BONUS" outcome on a first GD, which received outcome identifier O-000013 and is due a benefit having an EV of 75 at any of a plurality of second GDs identified as GD-000004 to GD-000999. In row R500-4, player P-009936 obtained a "BONUS2-BONUS2-BONUS2" outcome on a first GD which received outcome identifier O-000014 and is due a benefit having an EV of 150 at any of a plurality of second GDs in Bank A, Room Z. Lastly, as shown in row R500-5, player P-002983 obtained a "KEY-KEY-KEY" outcome on a first GD which received outcome identifier O-000015 and is due a benefit to "unlock prize" that can be accessed by using a second GD GD-001234.

Such indications may be stored, for example, on paper that may be provided to the player. For example, a gaming device may print a "cashless gaming ticket" (e.g., immediately upon receiving a random outcome yielding such a benefit, or later when the player cashes out) that indicates that a benefit is due to the player.

In some embodiments, such indications may be stored in a centralized database as data that is associated with the player. In this case, in order to claim the benefit, the player may need only go to the second GD and provide a player identifier to a reader device, and then the benefit stored in the central database is provided upon verification of the players' identity. For example, the player may be required to submit to provide a thumb print to a biometric reader device, or to submit to an eye scan by an eye scanner, so that a biometric indication of his identity is provided. In some second GD reader device configurations, the player may be required to insert a player tracking card, and/or a smart card, and/or a magnetic strip card (such as a credit card) that can be read and the data obtained used to identify the player. The identity data would then be matched to the data stored in the centralized database, such as a benefits database, and the benefit then provided at the second GD.

Figure 6:
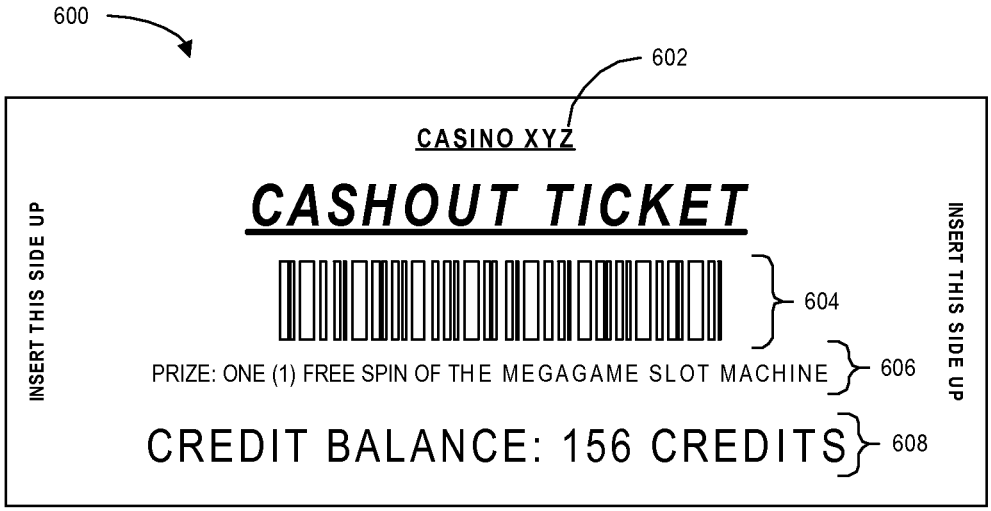
FIG. 6 illustrates a cashout ticket in accordance with an aspect of the invention.

FIG. 6 illustrates an example of a "cashout ticket" 600 that includes the name of the casino 602, a barcode 604, text 606 (which may include graphics) that describes the benefit as being "One Free Spin of the MegaGame Slot Machine", and a Credit Balance (shown in this example as 156 Credits) if the player has a positive credit balance when he terminates play. In some embodiments, the indication of the benefit and/or any credit balance may also be encoded, for example, in a barcode such as the barcode 604 that may be read by a second GD and understood (without even accessing a database) as "one free spin". In another example, such a barcode may include data pointing to a database such as the benefit database 500 of FIG. 5, and may encode further data such as a player identifier 502 and/or an outcome identifier 504. In addition, upon insertion of the cashout ticket, a second GD could access other data as needed.

An indication that the player has been awarded a benefit may also be provided to the player via a chip, or by dispensing a customized coin or a token. For example, an RFID enabled casino chip may be dispensed by a first GD, which when read by a second GD unlocks a benefit for the player, such as permitting the player to obtain additional game play at the second GD. In some embodiments, the RFID casino chip and/or the customized coin and/or the token, includes a security code that triggers a payout or other benefits at a second GD, which may or may not be made apparent to the player. Such a security code may be eroded, and it may be possible for the player to use a device to decode the security code to authenticate the benefit. For example, the player may be permitted to verify that the value of the benefit obtained at the second GD matches the benefit that was determined by the first GD (i.e., that the benefit was not changed and/or was not determined by the second GD).

Other benefits due to the player may also be stored. For example, in addition to storing benefits exclusively redeemable at second GDs (e.g., spins won at a first GD that must be played at a second GD), a cashless gaming ticket and/or a database may indicate benefits (e.g., game credits) won by players that may not have such redemption or play restrictions associated with them. For example, a cashless gaming ticket may encode and/or point to a database record that indicates "free" game play and/or promotional (non-cashable) credits that a player is entitled to redeem at one or more appropriate "second" devices, and (ii) cashable credits that the player has already accumulated through game play.

4. Indicating Award of Benefits

An indication may be output by the first GD that the player is due a certain or uncertain type of benefit. For example, a display of the GD may provide the message: "You've won a number of game credits!" instead of a generic message such as "You're won a prize!". In addition, the indication may be even more specific, for example: "You've won 65 game credits!" The indication of one or more benefits may have a certain or uncertain value, for example, "You've won a mystery bonus blackjack bet!" versus "You've won a free $5 blackjack bet!" versus "You're guaranteed 5 credits but can win up to 10,000!" versus "You've won an amount of cash between $100 and $200". Thus, depending on whether a type of benefits, number of benefits, or value of the benefits has yet been determined by a first GD or by a server (or will later be determined by a second GD or by a server such as a casino server), various information may be output as is appropriate. Moreover, as described, in some embodiments, data about a benefit (such as a value of a monetary payout) may be determined by a first GD, but not revealed to a player until he redeems the benefit at a second GD (e.g., a "perceived mystery" prize).

An indication may include information regarding redemption of the benefit, such as the type and/or location of the applicable redemption devices. For example, instructions could be output to the players' cell phone, and/or a first GD may output a "map" that directs the player to a second GD (or group of second GDs) at which a benefit may be redeemed. Such a map may be printed and dispensed to the player from the GD, and may be of the floor plan of the slot floor of a casino, including the players' current position (at the first GD), and a route to follow to find the second GD or bonus-round only GD where the benefit can be redeemed. Alternately or in addition, an alert may be output to a casino hostess, for example, instructing the hostess to guide the player to the second GD so that the player can accept the offer for the benefit.

The indication of the benefits may also include restrictions associated with redemption. For example, a first GD may output a time frame during which a benefit may be redeemed at a second GD.

The performance and/or history data associated with various potential redemption devices (second GDs or one or more bonus-round only devices) may also be presented to the player. For example, "Machine B has achieved 10 consecutive winning outcomes, Machine C has achieved 0 consecutive winning outcomes"; or "Machine B's last payout: 150 coins, Machine C's last payout: 10 coins". Players may then use such information to base a decision to redeem a benefit at a particular GD if they feel it may influence their luck.

The player may also be provided with an indication that includes an explanation of why the player has been provided with the benefit. For example, "Congratulations, because you're a Platinum Tier casino player, not only do you win 100 credits right now for hitting Bar-Bar-Bar, but you also win a free bonus spin on the Mega Wheel near the casino entrance".

Figure 7:
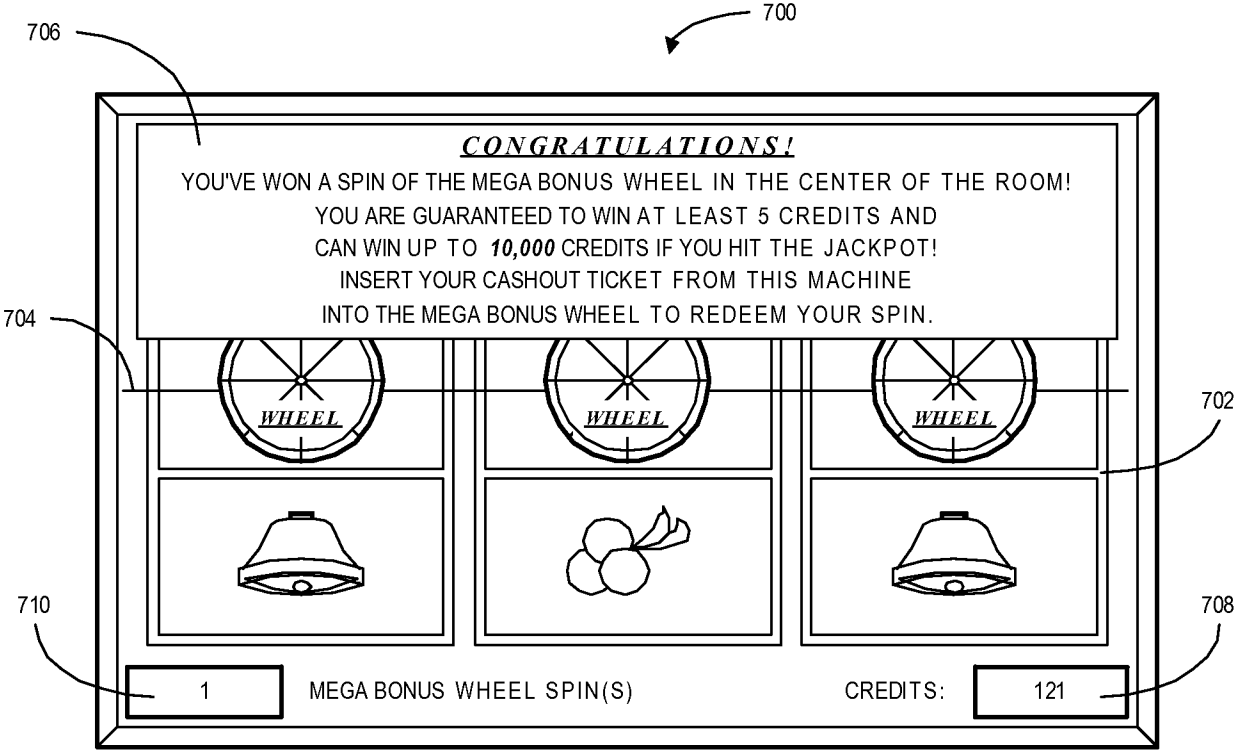
FIG. 7 illustrates an example of a display screen output that provides a player with an indication of an offer for a benefit according to an embodiment of the invention.

Such indications of achieving an award or a benefit may be output for the player in any number of various ways. FIG. 7 illustrates a display 700 of a first GD, which may be a video screen, a flat panel display, or some other display device. In this example, the main portion 702 of the display screen shows that a "WHEEL-WHEEL-WHEEL" outcome has been obtained along a payline 704. A message 706 has been superimposed on the screen 702 that recites:

> "Congratulations! You've won a spin of the Mega Bonus Wheel in the center of the room. You are guaranteed to win at least 5 credits, and can win up to 10,000 credits if you hit the jackpot! Insert your cashout ticket from this machine into the Mega Bonus Wheel to redeem your spin."

Also shown is a credits meter 708 that indicates that the player has 121 credits at this first GD, and a "Mega Bonus Wheel Spins" meter 710 that indicates that the player has earned one such spin thus far. The player can elect to cashout at this time and use his cashout ticket at the Mega Bonus Wheel GD (which may be a bonus-round only GD), or continue playing the first GD and cashout at a later time.

Other indicators could be used instead of, or in addition to a video screen. For example, an LED indicator such as an LED meter that tracks the benefits that a player wins while playing the first GD may increment by the number of benefits won. Further, an auxiliary display device for communicating such benefits, for example, may be used in some embodiments. For example, a "second GD benefit tracking hardware module" may be available as a retrofit device that could be sold to casino operators to be fitted to existing machines. For example, a separate LED meter may be added on top of each slot machine or other type of GD on the casino slot floor to track the "Spins of the Big Bonus Wheel" that are awarded to players.

Speakers (audio output) may be used to indicate the award of benefits to a player. For example, any or all of the information discussed above concerning the indication of a benefits award may be alternately or additionally output by audio speakers (which may be in a heads et worn by a player) in an aural manner. For example, a sound file stored in memory of a first GD executes, such that a voice proclaiming, "Congratulations, you've won a free bonus round on the Big Bonus Machine" is heard by the player.

A paper indication may be produced, such that any or all of the above information may be alternately or additionally output on a paper substrate, such as a cashless gaming ticket, as previously described. In addition, any or all of the above benefits award information may be alternatively or additionally output on another type of substrate, component or device, for example, in an RFID-enabled casino chip or coin that could be dispensed from the coin hopper of the first GD.

An indication of a benefits award may also be electronically transmitted to another device. For example, a GS or casino server and/or a first GD may transmit an indication to a server such as a central slot server where the information is then stored. In some embodiments, a slot server may transmit such benefits data to a second server. For example, data regarding benefits due to a player is transmitted to a Web server, and the player may be permitted to view such information online. In another example, the benefits data may be transmitted to a handheld device (e.g., a handheld gaming device) that may be associated with a player, such that the player can track benefits that are due (and possibly benefits that have been redeemed). Such benefits data may also be transmitted and/or accessed by authorized casino personnel or by a regulator, for example, by using a portable device, or by surfing to a secure website and entering an access code or security code.

5. Requests to Redeem Benefits

A request to redeem a benefit awarded by a first GD by using a second GD may include receiving one or more inputs (e.g., from a player using the second GD) that indicate redemption is desired. For example, as described above, the player may first input a cashout ticket and then actuate a button, or may press a portion of a touch-screen. For example, a touch screen display may include a message: "Press Here to Redeem A Bonus Round Entry" with a button icon. In another example, a player may be invited to press a "spin" or "deal" button, which signals that the player would like to redeem a benefit such as promotional credits. In some embodiments, the player may also be permitted to configure wager amounts and/or one or more paylines, such that the request may not only indicate (i) that the player would like to redeem a benefit, but also indicates (ii) how many of the benefits the player would like to redeem (for example, the player may be prompted to select a combination of wagers per payline and a number of paylines to activate to equal 23 promotional credits).

In some embodiments, the availability and appearance of such "actuation" functions is constantly available. That is, a second GD may be a "Bonus-round only" device that includes hard wired buttons and/or options of a touch-screen that a player may always access. In some embodiments, the actuation functions are embedded within a menu that a player must proactively access (e.g., a button icon may be visible at all times or player may only gain access by pressing a "menu" button). In some other embodiments, the function only becomes available or "pops up" once an identifier associated with the benefit or some other trigger is received.

Figure 8:
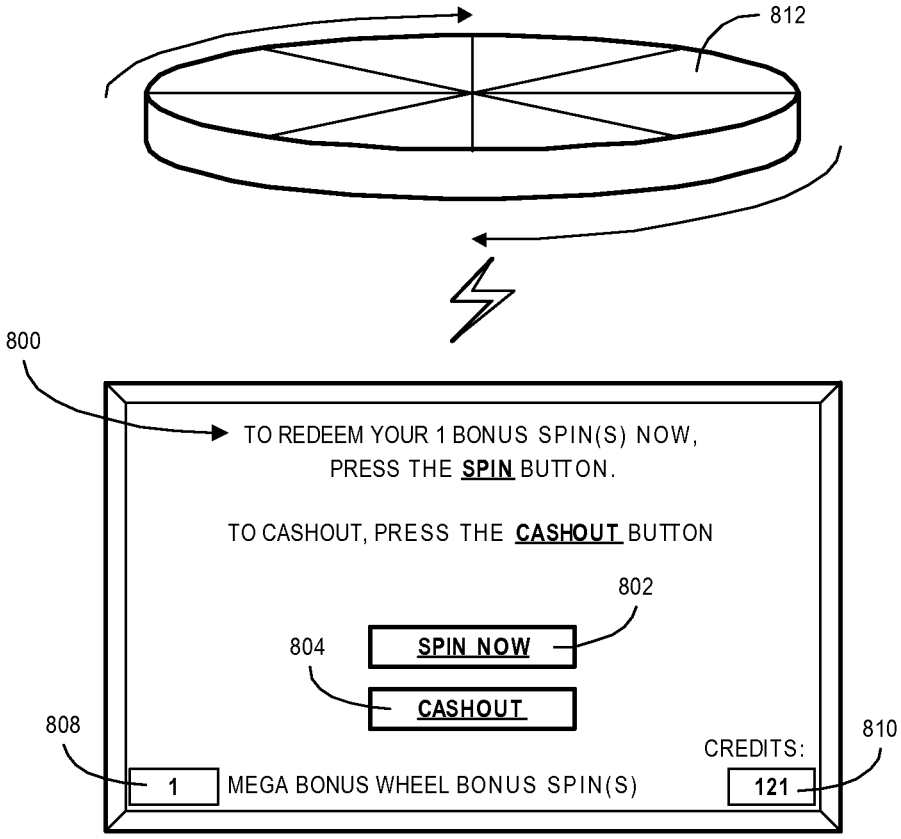
FIG. 8 illustrates an example display screen of a second GD which is providing a benefit according to an embodiment of the invention.

FIG. 8 illustrates a touch-screen display 800 of a second GD that has "popped up" after the player inserted a cashout ticket to request redemption of a benefit, which in this case is a bonus spin. For example, the cashout ticket that was inserted indicates that the player is due a spin of a "Giant Bonus Wheel". In response, the screen of the second GD configures itself to display a "Spin" icon 802, a cashout icon 804, a "Mega Bonus Wheel Spins" credit meter 808, and a credits meter 810. The player may press the spin icon 802 to obtain his benefit award, or may press the "Cashout" icon 804 to obtain a payout of the 121 credits due to him. If the player presses "Spin", the screen may again reconfigure itself to present a spinning disc 812 having a plurality of pie-shaped portions, each of which may be labeled for example, with different possible winning outcomes (not shown).

The second GD may require receipt of an identifier associated with the benefit and/or with the player. For example, a cashless gaming ticket that includes a barcode that encodes an identifier associated with a benefit due to a player may be required. The barcode may encode an "outcome identifier" and/or a "player identifier", and may also encode the amount of standard credits due to the player. In some embodiments, as described above, receipt of a player tracking card may be required, which may include an encoded player ID, such that data regarding benefits may be referenced (e.g., via a database such as the benefits database 500 of FIG. 5). In some embodiments, receipt of a code via an input device may be required to be entered via a keypad, or touch-screen, and the like. Examples of codes that may be required include a player ID, or a player's PIN number. In some embodiments, receipt of a biometric identifier such as data from a fingerprint scan, or receipt of a signal from an RFID-enabled casino chip or receipt of a customized coin, may be required. In addition, in some embodiments, more than one input may be required (e.g., a player tracking card must be used in addition to entering a PIN; a cashout ticket must be inserted, followed by pressing a "spin" button; and the like).

6. Determining Whether to Allow Redemption

In some embodiments, a determination is made as to whether to allow a player to redeem a benefit. For example, redemption of a benefit may generally include: (a) determining an identifier associated with a benefit (e.g., an identifier received while playing a first GD), (b) determining parameters associated with the benefit (e.g., redemption restrictions associated with a benefit), and (c) determining whether the player is allowed to redeem a benefit based on certain parameters. For example, permit redemption if a player inserts a cashless gaming ticket, and the ticket encodes an "outcome ID" such that a game result database 400 of FIG. 4 and/or a benefits due database 500 of FIG. 5 can be accessed to identify a payout and/or a benefit due in association with the outcome ID. In another example, a player simply inserts his player tracking card, triggering a second GD to access the "benefits due" database 500 (or a "benefits due" record of a player database) and provide the player with an opportunity to signal his desire to redeem one or more benefits that are due (e.g., a message may appear that recites: "Your Player Tracking Card indicates you are due a free spin on this machine. Would you like to redeem it?"). In another example, the player enters a PIN code and a list of benefits that are due to him appears on a display screen. He then may be able to use a touch-screen to indicate that he'd like to redeem one or more particular benefits (e.g., a bonus round entry) from the list. In another example, a player places a 23-coin wager and presses a spin button, signaling he'd like to redeem 23 promotional ("non-cashable") credits.

Generally, determining parameters associated with a benefit may comprise accessing a benefits due database or reading a ticket to determine an award value that may be associated with certain parameters, such as the type and/or value and/or the number of benefits available. For example, a "benefits due" field of a benefits due database may indicate "75 (EV)," which may be understood to mean that a player is due a game play that probabilistically yields an average payout of 75 coins, or may indicate "27 promo credits," indicating a player is owed 27 non-cashable promotional credits. The database may also include entries that indicate "1 bonus round entry," meaning that the player is entitled to play one bonus round, and "Unlock 1 prize," meaning that the player may "unlock" one prize awarded at a second GD that the player otherwise may not have been able to collect.

In one embodiment, benefits may have different values when redeemed. For example, a benefit may be good for 1 bonus round of Machine A, or two bonus rounds of Machine B, or may have different values at different times of day (e.g., the benefit is worth 20 credits if redeemed today, or 25 if redeemed tomorrow). Benefits may only be redeemable at certain redemption devices, such as particular GDs located in particular locations, at any of a group of particular devices, or at a group of GDs having any or all of certain predetermined characteristics that may include a location, a manufacturer, a game type, an identifier, and a denomination (e.g., wager amount).

As mentioned above, the player may be restricted to redeeming a benefit during a certain time period. For example a player may only be able to redeem a benefit during a particular time of day, on a particular date, and/or on one or more days of the week. In some embodiments, as explained above, a determination of whether to permit the player to redeem benefits may be based on one or more parameters, and a program may check an identifier associated with the benefit against various parameters and/or restrictions. In particular, such a process may be followed so that redemption is allowed only if, for example, the redemption request is for an available type of benefit. For example, if the player does not have a benefit of the same type available for redemption (e.g. the player requests a bonus round entry but a database indicates the player is entitled to only non-cashable credits, but not a bonus round entry), then the redemption request may be denied or disallowed.

The bonus request must be for an available quantity of benefits (e.g., if the player requests to wager 25 non-cashable credits but has only 13 remaining, the redemption request is denied). Further, it may be required that the redemption request be received from an appropriate or particular device (e.g., if a player attempts to redeem a benefit using GD-012978 and the only permissible redemption device is GD-000004, redemption is denied). In some embodiments, the redemption request for benefits must also be received during an appropriate time period (e.g., if the only time period restriction is "Not valid Thursday through Sunday" and the redemption request occurs on Tuesday, the redemption is allowed).

In some embodiments, the player may have the option to redeem a benefit by choosing between a plurality of second GDs, or by making a request to exchange the offer for a benefit for a different benefit offer. For example, if another player is using a particular second GD, or if the player does not like the theme or style of the second GD, the player may be permitted to obtain game play at another type of GD in order to redeem the offer for benefits. In such a case, a casino representative may become involved, for example, allowing the player to swap his cashout ticket containing the original offer for the benefit for a voucher that can be used at a different, second GD that is available and/or that appeals to the player. In some embodiments, if a player inserts his cashout ticket in a second GD that was not one of the choices of the original offer, the player may still be allowed to obtain the benefits at that second GD if, for example, a central server, casino server, or another controller device has enough data to determine that such a request is reasonable and/or equitable. Such a determination may be made based on various factors, such as player data, time of data, and the utilization and/or availability of GDs, the utilization and/or availability of bonus round GDs.

If redemption is disallowed, it may trigger an output device of a second GD to output a message. For example, a display screen may read "Sorry, you have no more bonus round entries", and/or speakers may output a voice saying "Sorry, you have no more bonus round entries", and/or a TITO device may reject a cashout ticket. For example, if a player inserts a cashout ticket or another type of paper voucher into a ticket reader of a second GD, the process may include (i) receipt of the ticket, (ii) reading an identifier associated with a specific benefit indicated by a barcode, (iii) accessing a database to determine parameters and/or any restrictions associated with the identifier, (iv) determining that one or more of the parameters and/or restrictions are such that player is not allowed to redeem, and then (v) rejecting the ticket by reversing the motor of the ticket input slot, so that the ticket is pushed back out of the slot so that it can be retrieved by the player.

In some embodiments, the player may request to redeem a benefit when multiple benefits are due. When the player indicates a desire to redeem one or more benefits (e.g. by inserting a cashout ticket indicating a plurality of benefits are due, by accessing a menu screen for redeeming benefits, etc.), then a process may be implemented to satisfy the players' desire. For example, a GD may be configured to (i) receive a request to redeem a benefit, (ii) output a list of the plurality of benefits due to the player, and (iii) receive a player selection for receipt of one or more benefits to be redeemed. For example, a player inserts a cashout ticket, and then a database (e.g., a benefits due database) is accessed to determine what benefits are due. If multiple benefits are due, then a list is output to the player via a touchscreen device, and a message such as "You may redeem any of the following: One bonus round entry; 36 promotional credits" is displayed. The player then selects which benefits to redeem, and the player may have the ability to identify the type and/or the number of benefits to redeem. For example, the player may select "promotional credits" and may redeem any amount up to 36 (and the player may be able to input a specific amount of credits or press a button that indicates "take all 36").

In some embodiments, a second GD may be configured to allow for various functions concerning the redemption of benefits. For example, a player may be permitted to execute game play provided as a second-GD-specific benefit. For example, the player can insert a "free bonus round" ticket and play a bonus round, or can redeem "promotional credits" to play any game that is offered by that GD, and the like. In some embodiments, the bonus-round is a "special" bonus-round only offered by the GD and/or for players redeeming such cross-machine benefits. In some embodiments, the player can simply "cash-out" a predetermined payout, or the player can redeem various other benefits as described (e.g., utilize game features provided as second-machine benefits, and the like).

In some embodiments, the game play is not necessarily related to redemption of benefits. For example, in one embodiment the player can execute game play provided as a second-machine-specific benefit and/or any player can purchase that at will. In an example, given Machine A, a first player can insert a $20 bill and play the machine at will, and/or a second player can insert a cashout ticket indicating he is entitled to redeem 25 non-cashable credits on Machine A (which are credits previously awarded by Machine B) and play the same type(s) of game(s). In some embodiments, players may utilize input/output devices to insert currency, to cashout credit balances by receiving currency or tickets, and the like.

In some embodiments, the player may be able to recall or replay or re-display the "benefit-triggering" game results from the first GD. For example, the second GD that is going to be used to redeem the benefit "won" or "earned" at the first GD may be configured to "replay" the game result, which yielded the benefit. For example, the player plays Slot Machine A and the reels spin and the player achieves a result of "Bonus B-Bonus B-Bonus B". The player then receives a cashout ticket encoding "Bonus B-Bonus B-Bonus B", and inserts that ticket into Machine B to redeem the benefit. Machine B decodes the ticket and then outputs ("replays") the sequence of reels spinning and resolves to the "Bonus B-Bonus B-Bonus B" winning result. In some embodiments, all that is required to achieve the replay of the winning result is the insertion of the identifier such as the cashout ticket, and thus the player could present the cashout ticket to a friend or family member as a gift, for example, so that the person could experience a "winning" outcome. In this embodiment, it may also be possible for the person to use the benefit awarded to the player, for example, to obtain the bonus-round game play.

Various output devices can be utilized at a second GD to replay the winning results, such as a display screen, speakers, and the like. "Static" graphics, such as images of slot machine symbols can also be recalled, or a video presentation recreating the original spin, including animation could be presented. In some embodiments, an indication is also provided that makes it clear that the presentation is a replay and not a new game result, so that players cannot complain when additional benefits are not provided. For example, a text message may be displayed "This is a replay—no further benefits will be provided", or in some embodiments the text may recite "First, let's replay how you won your first bonus spin" and/or a voice may state "Here's your replay spin". Additionally, data regarding the generation of the original, benefit-triggering game result may be accessed and an indication provided of the device that generated result, and the time and/or date stamp of when the result was generated.

In some embodiments, the replay may be output upon player request. For example, a message may appear that recites "You're entitled to redeem one bonus round entry. But first, would you like to see a replay of how you won your bonus round?" In some embodiments, the replay is played automatically, such as before each benefit is redeemed.

In some embodiments, certain functions are restricted that are not related to the redemption of the second-machine-specific benefits. For example, redemption of such benefits may be required before some other function is allowed. For example, in order to cashout out any amount of (cashable) credits, a player must first redeem his free bonus round entry. For example, a player may have a balance of both "credits" and "spins," which he may have arrived at by inserting a cashless gaming ticket that includes encoded (i) regular credits a player may be due to cash out and (ii) other benefits, as described. Thus, the second GD may require that any or all other benefits must be redeemed before cashout is allowed (e.g., the balance of "spins" must be zero, or at least one "spin" must be played, etc.). Such operation prevents players from using "bonus only" machines or second GDs that are geared toward redemption of elaborate bonus presentations for simply cashing out, etc. Other functionality may only be available based on other factors such as a time and/or date, player status, device utilization data, and other data.

7. Providing the Benefit

After determining whether to allow redemption of a benefit, the benefit may be provided and may include game play and/or a predetermined payout that has not yet been revealed. For example, a meter that tracks available "bonus spins" is incremented by one, such that the player may press a "spin" button that may trigger the second device (and/or server) to generate a random result, or a player is launched directly into a bonus round (e.g. the player is immediately presented with three treasure chests from which he must choose one), and based on the player's selection, he is provided with an award, or a slot machine executes five spins automatically that yield a predetermined result of 75 total coins, or a credit meter associated with "non-cashable credits" is incremented by a number of non-cashable credits owed to a player.

A second GD, a server such as a casino server, or some other device may determine a value associated with the benefit. For example, the value may be predetermined by a first GD, and a second GD then looks up a value stored in a database in association with a particular identifier that the player provided (e.g., a player ID read from an inserted player tracking card, or a barcode containing such data read from a cashless gaming ticket, etc.) to provide the predetermined value. For example, a value of 80 credits may be provided as the result of one or more slot machine spins (e.g., one spin resulting in a win of 80 credits, two spins each resulting in a win of 40 credits). In another example, a first GD may randomly determine the range of a payout (e.g., $100 to $300), and a second GD randomly determines the specific amount within the range (e.g., $174), so that both the first GD and the second GD have a role in determining the payout amount.

In some embodiments, the award value may be an Expected Value (EV) that is indicated by an identifier. For example, a barcode and/or a record of a database indicate an EV of "+75 credits." The second GD may then provide that EV, by providing a game play that has the same EV. For example, in an embodiment, the EV is a function of (i) probabilities of achieving certain results of a set of results, and (ii) payouts associated with those results, and each set of results with different probabilities and or payouts may have a different EV. Therefore, in some embodiments, a second GD may choose an appropriate set of results against which to randomly determine a result, based on an indicated EV. For example, a plurality of sets of results (e.g., which in some embodiments may be a plurality of different "paytables") each can be associated with an EV (e.g. a first set of results yields an average payout of x, a second set of results yields an average payout of y, and the like). Thus, in a specific example, if an EV of "+75 credits" is presented, a second GD may access a paytable (e.g., from a database of paytables stored in memory) that has an EV of 75 credits (e.g., yields a payout of 75 credits on average per game play).

In some embodiments, more than one paytable might yield the same EV. In such a case, the second GD may randomly select one paytable from a plurality of paytables offering the same EV. In another example, a "bonus redemption only" device may include a larger than normal electromechanical wheel. Thus, when such a device receives an indication of an EV due to a player, the probabilities of randomly achieving various "sections" on the wheel are adjusted such that the spin provides the EV that is due.

In some embodiments, a "Paytable" may be indicated by an identifier, which may be viewed as a different way to achieve a result similar to the results discussed above. For example, rather than receive an "EV" which is then correlated to one or more paytables, an identifier for a specific paytable may be directly indicated (e.g., by a cashless gaming ticket, an outcome ID, another code, etc. received by a second GD). For example, a cashless gaming ticket may encode an identifier of "PT-1989212", so that a particular paytable is selected against which to generate one or more random results (e.g., obtained from a database). In another example, the award value is predetermined, so that, for example the a player is provided with a predetermined payout that has already been revealed (e.g., the player inserts a cashless gaming ticket into a second GD and receives a payout of 10 coins, as advertised.)

In an embodiment, a player is provided with an entry into a bonus round redeemable at a second GD, at which the player may be presented with various "masked" awards, as is known in the art. For example, in the bonus round, four boxes are presented, each labeled with a "question mark" icon. The player may then choose a box and be provided with a corresponding award. For example, a first box may be associated with a payout of $0, a second box with a payout of $5, a third box with a payout of $10, and a fourth box with a payout of $50. Accordingly, if a player selects the fourth box (e.g., chooses "Box #4" of four boxes labeled with a question mark), he may be awarded with a payout of $50. In some embodiments, the player provides a tangible medium, such as a cashless gaming ticket, that is read by a reading device of the second GD, and based on data indicated by the medium, the second gaming device may determine a set of awards which may be presented to the player in such a format (e.g., four awards which may be obfuscated and presented to the player, such that the player may select one). For example, the cashless gaming ticket may indicate "Bonus Pool BP-000101," meaning that the second GD may access a database that stores prize amounts in association with different bonus pools (sets of payouts). In this manner, a player may be provided with an EV by means of the average amount paid to players selecting an award from a given pool indicated by a cashout ticket. Continuing the above example, the EV associated with the bonus round entry may be $16.25 (i.e., the average of the payouts, which in this case is the sum of the four payouts divided by four ($0+$5+$10+$50)/4)). Thus, a first GD may determine an EV due to a player by determining a pool of awards from which a player may select one or more (it being assumed the play has an equal probability of selecting each of the awards, as their position may be "shuffled" from bonus round to bonus round), and a second GD may output the pool of awards in a masked or obfuscated manner (i.e., such that the award value is not known by a player until he selects an icon), allowing the player to select one or more awards in particular.

In some embodiments, a player is provided with a game feature. For example, a second GD receives a particular ID and/or code and thereby the probability of achieving one or more outcomes of Machine B is favorably modified. For example, a probability metric for achieving a jackpot outcome that is stored in a database may be effectively increased by 5% (e.g., more random numbers are added to a range of random numbers that would yield the result). In another example, a second GD receives a particular ID and/or code and thereby "Bar-Bar-Bar" of Machine B will pay an extra 25 coins (e.g., the payout database is modified to add 25 extra coins to a payout).

In some embodiments, the benefit may include provision of a game resource and/or indicia. For example, one or more databases may be updated to indicate that the player is entitled to one or more of a "wild" card or symbol to use at any time in main game, a "Hammer" resource to "nudge" or realign slot reels post-outcome, one free lemon symbol (e.g., if the player is able to collect four more to achieve a total of five, a payout is awarded), and a "Key" resource to unlock payout/treasure player may win randomly at second device. Various other types of benefits may also be awarded. For example, the player may be entitled to receive one or more units of media content (e.g., a unit may be a free song), comp points, gift certificates, and the like. The player may be provided with access codes or other means to claim such benefits, for example, a code may be provided that indicates a database containing a list of free songs from which the player can choose.

8. Additional Descriptions of Some Embodiments

In some embodiments, the first GD and the second GD is the same gaming device. In such a case, the player may win a benefit at the first GD, but rather than be forced to redeem it at a second GD, he may be given an offer to redeem it at the same, first GD, at a later time. For example, player achieves "Sunset-Sunset-Sunset" and then is presented with the message: "25 coins have been sent to your bank! Collect them on this machine between 5:00 and 7:00 this evening. Insert your player tracking card and press the 'Banked Payouts' button during this time to collect your coins".

In some embodiments, a partial outcome may be provided at a first GD, and the outcome must be finished or resolved at a second GD. For example, a player gets "Bar-Bar-?" at a first GD, and must go to a second GD to achieve the third symbol. As stated above, the third symbol may be (i) determined by the first GD and simply not communicated until player visits second GD, or may be (ii) determined by the second GD. Such an outcome may be a "bonus" in addition to another outcome. For example, the player spins reels at the first GD and obtains a "Cherry-Cherry-Cherry" outcome (winning 20 coins or 20 credits), which triggers a "bonus spin" that resolves to "Bar-Bar-?" which the player must complete at a second GD.

In some embodiments, the player may be permitted to convert certain "credits" to "game plays". Referring again to FIG. 8, a player of a second GD may have a balance of "1 spin" and "121" credits (e.g., such that after the player redeems a "spin," any winnings may be added to the balance of "credits"). Instead of cashing out, the player may be permitted to use such credits to "purchase" spins or game plays provided by the second GD, and this may be a similar process to placing a wager, but the price of a spin and/or game play may be variable. For example, the price of purchasing a spin may be based on such parameters as player status, time of day, and capacity and/or "revenue management" factors.

In some embodiments, a player is not permitted to convert credits at a second GD to game play (e.g., a casino only wants players to use the "big bonus wheel" for redemption of spins won at other GDs and does not permit the purchase of additional spins). If a player were able to convert credits earned at a first GD to game play at the second GD, then a bottleneck may be caused. This may occur when multiple players are directed to the second GD to obtain their benefits, but a first player is "hogging" the machine because he has a large (i) balance of game plays and/or (ii) balance of credits. This type of situation may be undesirable for a casino, for example, that desires to cycle a variety of players through the "Mega Bonus Wheel" GD in the center of the slot floor to create excitement and/or to encourage players to play wagering games.

In some embodiments, a casino may desire to drive players "back" to other GDs from the second GD or "Bonus-round only" machine. Thus, several methods may be implemented to force or to motivate players to recycle second GD winnings back onto the slot floor, especially in cases wherein a casino limits and/or prefers players to use a "big bonus wheel" or other bonus-round only device for redemption of spins won at first GDs. For example, the benefits are determined or revealed by the second GD, but may only be redeemed at a third GD. The third GD may be any standard slot machine, or may be the same as the first GD, or may be some other specified device or group of devices. For example, the player plays Generic Slot A, wins a spin on Bonus Machine B and then the spin on Bonus Machine B yields 30 non-cashable credits playable on any of the Generic Slots Machines A-Z.

In some embodiments, after a benefit has been achieved at a first GD, the player uses a second GD, which determines or reveals the benefit, which may be redeemed for value at the second GD, but may be redeemed for more value at a third GD. For example, player plays Generic Slot A, wins a spin on Bonus Machine B. When he inserts a ticket into Bonus Machine B, various meters indicate:

| | |
|---|---|
| Spins | 1 |
| Credits won | 0 |
| Or | |
| Generic Slot C credits | 0 |

In this case, the player then redeems the spin, and (see table below) wins (i) 20 credits redeemable at any machine (e.g., can be redeemed right then at Bonus Machine B), or (ii) 20 cashable credits plus 5 non-cashable credits at Generic Slot C (e.g., motivating the player to utilize Generic Slot C, which may be new, under-utilized, etc.)

| | |
|---|---|
| Spins | 0 |
| Credits won | 20 |
| Or | |
| Generic Slot C credits | 20 + 5 promo credits! |

In some embodiments, the player may be required to revisit the first GD to obtain his benefit. And in an example, the first GD may be "locked up" or "reserved" in the interim so that no other patrons can use the first GD while that player is at the second GD.

In some embodiments, the player may be able to opt-out of receiving any offers for benefits while playing a first GD. For example, a menu option may be presented to the player when he first initiates game play that includes one or more player preferences or options, and the player may select an option that prevents benefit offers from being made to that player while he is engaged with playing the first GD. For example, a handicapped player may prefer to play a particular GD located in an easily accessible area of the slot floor and does not want to have to leave that GD in order to redeem an offer for a benefit at a second GD.

In some embodiments, the second GD is not a gaming device. For example, the first GD may provide a benefit for one or more hands at a blackjack table, or at some other card game offered by a casino, or one or more outcomes of some other type of wagering game. In addition, the player could win entry to a "live game show" that includes a host, that may be held within a casino, or win entry to another type of event that may or may not be sponsored by the casino.

In some embodiments, the player may be able to "bank" benefits for later use with a "Video Bonus Round Redemption Machine". For example, a player plays various slot machines throughout the day, and from time to time wins bonus game play entries. The player can choose to either "play" the bonus game plays at the time they are won or "bank" them. In some situations, the player may be required to "bank" them (e.g., bonus round entries may be issued by mechanical spinner-style machines, allowing them to offer exciting video presentations that are executable by other device, that the mechanical devices cannot display). Thus, for example, at the end of the day, a player may have banked 10 bonus round entries. These entries may be stored in his player account, such that the player might visit a "Bonus Round Redemption" machine, insert his player tracking card, and receive a balance of "10 rounds". To redeem such bonus round entries, the player may navigate a menu of skins or styles or themes or formats on a display screen and select one in association with an entry. For example, if player is due 10 rounds, he might have the option to select a different format after each round, or select a format that will be utilized for a plurality of rounds. In some embodiments, any "skin" may just be different way of communicating a value player will ultimately win.

Figure 9:
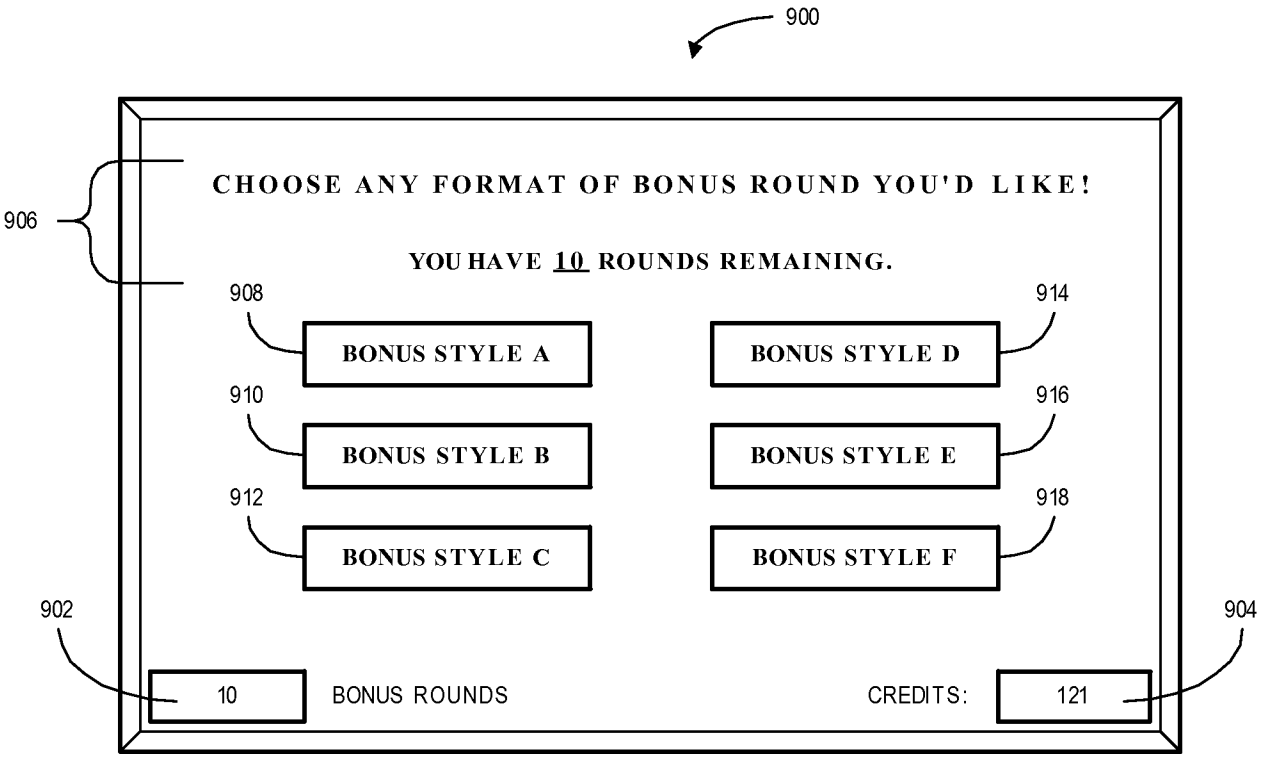
FIG. 9 illustrates an example of a menu displayed to a player to enable selection of a bonus-round game style according to an embodiment of the invention.

FIG. 9 illustrates an example 900 of a user interface that may be presented to a player by a "Video Bonus Round Redemption Machine". The display includes a bonus rounds credit meter 902, a credits meter 904, a message display 906, and a plurality of "Bonus Style" icons 908 to 918 that may be selected by the player to choose a style. The screen may also be configured with a "preview" button that may be pressed by the player to obtain a preview of static and/or dynamic multimedia content that could be output in association with a format that shows the player how his bonus rounds would appear. In some embodiments, the bonus rounds offered by the second GD may be thematically tied to the first GD or group of GDs on which the player won the benefits. For example, a player may have "banked" a bonus round while playing the "Crazy Voodoo Slots" GD, and then later "banked" another bonus round while playing the "Majestic Mountain Slots" GD. Accordingly, when the player visits a "Video Bonus Round Redemption Machine" and indicates he'd like to redeem one or more bonus rounds (e.g., inserts his player tracking card), the machine may output a "Crazy Voodoo Slots"-themed bonus round, followed by a "Majestic Mountain Slots"-themed bonus round. In some implementations, the format or style outputs do not need to be executed in the order in which they were won or earned. Rather, a player might be prompted with a menu, such as the menu shown in FIG. 9, wherein the menu is populated with specific bonus rounds the player had previous won.

9. Rules of Interpretation

Numerous embodiments have been described, and are presented for illustrative purposes only. The described embodiments are not intended to be limiting in any sense. The invention is widely applicable to numerous embodiments, as is readily apparent from the disclosure herein. These embodiments are described in sufficient detail to enable those skilled in the art to practice the invention, and it is to be understood that other embodiments may be utilized and that structural, logical, software, electrical and other changes may be made without departing from the scope of the present invention. Accordingly, those skilled in the art will recognize that the present invention may be practiced with various modifications and alterations. Although particular features of the present invention may be described with reference to one or more particular embodiments or figures that form a part of the present disclosure, and in which are shown, by way of illustration, specific embodiments of the invention, it should be understood that such features are not limited to usage in the one or more particular embodiments or figures with reference to which they are described. The present disclosure is thus neither a literal description of all embodiments of the invention nor a listing of features of the invention that must be present in all embodiments.

The terms "an embodiment", "embodiment", "embodiments", "the embodiment", "the embodiments", "an embodiment", "some embodiments", "an example embodiment", "at least one embodiment", "one or more embodiments" and "one embodiment" mean "one or more (but not necessarily all) embodiments of the present invention(s)" unless expressly specified otherwise. The terms "including", "comprising" and variations thereof mean "including but not limited to", unless expressly specified otherwise.

The term "consisting of" and variations thereof mean "including and limited to", unless expressly specified otherwise.

The enumerated listing of items does not imply that any or all of the items are mutually exclusive. The enumerated listing of items does not imply that any or all of the items are collectively exhaustive of anything, unless expressly specified otherwise. The enumerated listing of items does not imply that the items are ordered in any manner according to the order in which they are enumerated.

The term "comprising at least one of" followed by a listing of items does not imply that a component or subcomponent from each item in the list is required. Rather, it means that one or more of the items listed may comprise the item specified. For example, if it is said "wherein A comprises at least one of: a, b and c" it is meant that (i) A may comprise a, (ii) A may comprise b, (iii) A may comprise c, (iv) A may comprise a and b, (v) A may comprise a and c, (vi) A may comprise b and c, or (vii) A may comprise a, b and c.

The terms "a", "an" and "the" mean "one or more", unless expressly specified otherwise.

The term "based on" means "based at least on", unless expressly specified otherwise.

The methods described herein (regardless of whether they are referred to as methods, processes, algorithms, calculations, and the like) inherently include one or more steps. Therefore, all references to a "step" or "steps" of such a method have antecedent basis in the mere recitation of the term 'method' or a like term. Accordingly, any reference in a claim to a 'step' or 'steps' of a method is deemed to have sufficient antecedent basis.

Headings of sections provided in this document and the title are for convenience only, and are not to be taken as limiting the disclosure in any way.

Devices that are in communication with each other need not be in continuous communication with each other, unless expressly specified otherwise. In addition, devices that are in communication with each other may communicate directly or indirectly through one or more intermediaries.

A description of an embodiment with several components in communication with each other does not imply that all such components are required, or that each of the disclosed components must communicate with every other component. On the contrary a variety of optional components are described to illustrate the wide variety of possible embodiments of the present invention.

Further, although process steps, method steps, algorithms or the like may be described in a sequential order, such processes, methods and algorithms may be configured to work in alternate orders. In other words, any sequence or order of steps that may be described in this document does not, in and of itself, indicate a requirement that the steps be performed in that order. The steps of processes described herein may be performed in any order practical. Further, some steps may be performed simultaneously despite being described or implied as occurring non simultaneously (e.g., because one step is described after the other step). Moreover, the illustration of a process by its depiction in a drawing does not imply that the illustrated process is exclusive of other variations and modifications thereto, does not imply that the illustrated process or any of its steps are necessary to the invention, and does not imply that the illustrated process is preferred.

It will be readily apparent that the various methods and algorithms described herein may be implemented by, e.g., appropriately programmed general purpose computers and computing devices. Typically a processor (e.g., a microprocessor or controller device) will receive instructions from a memory or like storage device, and execute those instructions, thereby performing a process defined by those instructions. Further, programs that implement such methods and algorithms may be stored and transmitted using a variety of known media.

When a single device or article is described herein, it will be readily apparent that more than one device/article (whether or not they cooperate) may be used in place of a single device/article. Similarly, where more than one device or article is described herein (whether or not they cooperate), it will be readily apparent that a single device/article may be used in place of the more than one device or article.

The functionality and/or the features of a device may be alternatively embodied by one or more other devices which are not explicitly described as having such functionality/features. Thus, other embodiments of the present invention need not include the device itself.

The term "computer-readable medium" as used herein refers to any medium that participates in providing data (e.g., instructions) that may be read by a computer, a processor or a like device. Such a medium may take many forms, including but not limited to, non-volatile media, volatile media, and transmission media. Non-volatile media include, for example, optical or magnetic disks and other persistent memory. Volatile media may include dynamic random access memory (DRAM), which typically constitutes the main memory. Transmission media may include coaxial cables, copper wire and fiber optics, including the wires or other pathways that comprise a system bus coupled to the processor. Transmission media may include or convey acoustic waves, light waves and electromagnetic emissions, such as those generated during radio frequency (RF) and infrared (IR) data communications. Common forms of computer-readable media include, for example, a floppy disk, a flexible disk, hard disk, magnetic tape, any other magnetic medium, a CD-ROM, DVD, any other optical medium, punch cards, paper tape, any other physical medium with patterns of holes, a RAM, a PROM, an EPROM, a FLASH-EEPROM, any other memory chip or cartridge, a carrier wave as described hereinafter, or any other medium from which a computer can read.

Various forms of computer readable media may be involved in carrying sequences of instructions to a processor. For example, sequences of instruction (i) may be delivered from RAM to a processor, (ii) may be carried over a wireless transmission medium, and/or (iii) may be formatted according to numerous formats, standards or protocols, such as Transmission Control Protocol, Internet Protocol (TCP/IP), Wi-Fi, Bluetooth, TDMA, CDMA, and 3G.

Where databases are described, it will be understood by one of ordinary skill in the art that (i) alternative database structures to those described may be readily employed, and (ii) other memory structures besides databases may be readily employed. Any schematic illustrations and accompanying descriptions of any sample databases presented herein are illustrative arrangements for stored representations of information. Any number of other arrangements may be employed besides those suggested by the tables shown. Similarly, any illustrated entries of the databases represent exemplary information only; those skilled in the art will understand that the number and content of the entries can be different from those illustrated herein. Further, despite any depiction of the databases as tables, other formats (including relational databases, object-based models and/or distributed databases) could be used to store and manipulate the data types described herein. Likewise, object methods or behaviors of a database can be used to implement the processes of the present invention. In addition, the databases may, in a known manner, be stored locally or remotely from a device that accesses data in such a database.

It should also be understood that, to the extent that any term recited in the claims is referred to elsewhere in this document in a manner consistent with a single meaning, that is done for the sake of clarity only, and it is not intended that any such term be so restricted, by implication or otherwise, to that single meaning. Finally, unless a claim element is defined by reciting the word "means" and a function without reciting any structure, it is not intended that the scope of any claim element be interpreted based on the application of 35 U.S.C. §112, sixth paragraph.

Although the present invention has been described with respect to preferred embodiments thereof, those skilled in the art will note that various substitutions and modifications may be made to those embodiments described herein without departing from the spirit and scope of the present invention.

What is claimed is:

1. A non-transitory computer readable medium encoded with instructions for directing a processor to:

determine that a player of a first electronic game device qualifies to receive at least one benefit associated with an expected award value which is distinct from a quantity of monetary credits indicated by a credit meter of said first electronic game device; and output an offer to provide the at least one benefit, wherein:

(a) the offer includes a requirement to use a second electronic game device to redeem the at least one benefit, and (b) an actual award value of the at least one benefit is based, at least in part, on at least one random determination associated with a play of a game at the second electronic game device, said play of the game at the second electronic game device employing a paytable selected based on the expected award value associated with the at least one benefit, wherein if the at least one benefit is associated with a first expected award value, a first paytable associated with the first expected award value is selected and if the at least one benefit is associated with a second, different expected award value, a second, different paytable associated with the second, different expected award value is selected.

2. The non-transitory computer readable medium of claim 1, further directing the processor to:

receive a request for the at least one benefit at the second electronic game device; and provide the at least one benefit to the player.

3. The non-transitory computer readable medium of claim 2, wherein receiving the request for the at least one benefit comprises at least one of: an actuation of at least one button, an actuation of a touch screen, a receipt of an identifier associated with the at least one benefit, and a receipt of an identifier associated with the player.

4. The non-transitory computer readable medium of claim 3, wherein the identifier associated with the at least one benefit comprises at least one of: a receipt, a bonus receipt, a cashout ticket, a bonus ticket, a voucher, a token, an encoded chip, a barcode, and a code.

5. The non-transitory computer readable medium of claim 3, wherein the identifier associated with the player comprises at least one of: a player tracking card, a cashless gaming ticket, a player identifier code, a personal identification number, and a biometric identifier.

6. The non-transitory computer readable medium of claim 2, further directing the processor to, prior to providing the at least one benefit, determine whether to enable the player to redeem the at least one benefit.

7. The non-transitory computer readable medium of claim 6, further directing the processor to:

obtain an identifier associated with the player;

determine at least one parameter associated with the player; and permit the at least one benefit to be provided if the player satisfies at least one predetermined criteria.

8. The non-transitory computer readable medium of claim 7, wherein the predetermined criteria comprises presentation of at least one of: a valid player tracking card, a valid personal identification number, and a valid cashout ticket.

9. The non-transitory computer readable medium of claim 7, wherein determining at least one parameter further comprises at least one of: accessing at least one database, reading data from a ticket, and reading data from a magnetic stripe.

10. The non-transitory computer readable medium of claim 7, further directing the processor to deny the request for the at least one benefit if the player does not satisfy the at least one predetermined criteria.

11. The non-transitory computer readable medium of claim 10, further directing the processor to provide an indication to the player that the requested at least one benefit is denied.

12. The non-transitory computer readable medium of claim 11, wherein the indication comprises at least one of: a visual message provided on a display device, an audio message provided by at least one audio speaker, and a rejected ticket.

13. The non-transitory computer readable medium of claim 2, wherein providing the at least one benefit further comprises:

generating at least one random number;

selecting an entry of the selected paytable based on the random number; and providing a payout based on the selection.

14. The non-transitory computer readable medium of claim 13, further directing the processor to select the paytable by at least one of: a random determination, a determination based on at least one player criteria, and a determination based on at least one gaming criteria.

15. The non-transitory computer readable medium of claim 13, wherein the paytable is selected in association with the first electronic game device, and the random number is generated in association with the second electronic game device.

16. The non-transitory computer readable medium of claim 2, further directing the processor to, prior to providing the at least one benefit, determine the expected value of the at least one benefit by:

determining a plurality of paytables in association with the first electronic game device;

generating a plurality of masked awards, wherein each masked award is associated with one of the determined paytables;

providing the masked awards for selection by the player after receiving the request for the at least one benefit; and determining a benefits paytable corresponding to the masked award selected by the player.

17. The non-transitory computer readable medium of claim 2, further directing the processor to store data representing the at least one benefit in a memory of at least one of: a dedicated storage device, at least one of the electronic game devices, at least one electronic game server, and a casino server.

18. The non-transitory computer readable medium of claim 17, further directing the processor to provide access to at least a portion of the stored data to at least one of: an authorized casino personnel, a regulator, and the player.

19. The non-transitory computer readable medium of claim 18, further directing the processor to:

analyze the stored data for a plurality of players;

determine at least one trend based on the analysis; and modify at least one criteria used in determining at least one future benefit offer.

20. The non-transitory computer readable medium of claim 1, wherein the offer comprises at least one of: at least one play of the game of the second electronic game device, at least one outcome generated in at least one bonus game of the second electronic game device, at least one game play modification, at least one comp point, an amount of loss insurance, at least one multimedia option, and an acquisition of at least one unit of media content.

21. The non-transitory computer readable medium of claim 20, wherein the at least one game play modification includes at least one of: increasing a probability of a winning outcome, increasing a payout for at least one winning outcome, providing at least one electronic game device wild card symbol, and providing at least one free media content feature.

22. The non-transitory computer readable medium of claim 1, further directing the processor to output at least one identifier of the second electronic game device.

23. The non-transitory computer readable medium of claim 22, further directing the processor to provide the player with at least one of a display of information concerning the second electronic game device that includes at least one of: a game name, a game type, a game manufacturer, a plurality of game play instructions, a location of the second electronic game device, a map that includes the location of the second electronic game device, a printout of a map showing the location of the second electronic game device, a printout containing information associated with the second electronic game device, an alert to a casino employee to guide the player to the second electronic game device, and a plurality of instructions concerning the second electronic game device transmitted to a player device.

24. The non-transitory computer readable medium of claim 1, wherein the offer further comprises requiring at least one of: obtaining the at least one benefit during a predetermined time period, and obtaining the at least one benefit up to a predetermined threshold value.

25. The non-transitory computer readable medium of claim 1, wherein determining that the player qualifies to receive the offer comprises at least one of: a random generation, a player status, a time and a date consideration, an electronic game device availability, an electronic game device utilization, an electronic game device performance history, the player exceeding a threshold value of a plurality of losing outcomes, the player exceeding a predetermined threshold value associated with a duration of playing time, and the player exceeding a predetermined percentage decline in a credit balance.

26. The non-transitory computer readable medium of claim 1, wherein the second electronic game device comprises a bonus-round electronic game device located at a site that is physically remote from the first electronic game device.

27. The computer readable medium of claim 1, further directing the processor to, prior to non-transitory providing the offer, store at least one indication that the player is due the at least one benefit.

28. The non-transitory computer readable medium of claim 27, further directing the processor to store at least one of: the indication in at least one memory, the indication on a paper, and the indication on at least one of a chip, a coin, and a token.

29. The non-transitory computer readable medium of claim 1, wherein providing the offer further comprises providing at least one indication that the player qualifies for the at least one benefit.

30. The non-transitory computer readable medium of claim 29, wherein the indication comprises notice that the player is eligible for at least one of: at least one gaming credit, a prize, an award, a mystery prize, at least one game play with a predetermined set of possible results, at least one game play with at least one feature of the second electronic game device enabled, disabled or altered, and an explanation of why the player qualifies for the at least one benefit.

31. The non-transitory computer readable medium of claim 30, further directing the processor to provide the notice by at least one of: a visual output on a video display, an audio output from an audio device, a printed matter, an electronic transmission to a device, and a dispensing of at least one of a coin, a chip, and a token.

32. A non-transitory computer readable medium encoded with instructions for directing a processor to:

determine that a player of an electronic wagering game device qualifies to receive a conditional offer to obtain at least one benefit associated with an expected award value which is distinct from a quantity of monetary credits indicated by a credit meter of said electronic wagering game device;

provide the conditional offer to the player;

receive a request for the at least one benefit from the player at an electronic bonus game device; and provide the at least one benefit if the player satisfies at least one condition of the conditional offer, the provided at least one benefit having an actual award value based, at least in part, on at least one random determination associated with a play of a bonus game at the electronic bonus game device, said play of the bonus game at the electronic bonus game device employing a paytable selected based on the expected award value associated with the at least one benefit, wherein if the at least one benefit is associated with a first expected award value, a first paytable associated with the first expected award value is selected and if the at least one benefit is associated with a second, different expected award value, a second, different paytable associated with the second, different expected award value is selected.

33. The non-transitory computer readable medium of claim 32, wherein determining that the player qualifies to receive the conditional offer comprises at least one of: a random generation, a player status, a time and a date consideration, an electronic game device performance history, the player exceeding a threshold value of a plurality of losing outcomes, the player exceeding a predetermined threshold value associated with a duration of playing time, the player exceeding a predetermined percentage decline in a credit balance, an availability of the electronic bonus game device, and a utilization of the electronic bonus game device.

34. The non-transitory computer readable medium of claim 32, wherein the at least one benefit comprises at least one of: at least one play of the bonus game of the electronic bonus game device, at least one winning outcome generated in at least one play of the bonus game of the electronic bonus game device, at least one table game play, at least one game play modification, at least one comp point, an amount of loss insurance, at least one multimedia option, and an acquisition of at least one unit of media content.

35. The non-transitory computer readable medium of claim 34, wherein the at least one game play modification comprises at least one of: increasing a probability of a winning outcome, increasing a payout for at least one winning outcome, providing at least one electronic game device wild card symbol, and providing at least one free media content feature.

36. The non-transitory computer readable medium of claim 32, wherein the electronic bonus game device is located at a site that is physically remote from the electronic game device.

37. The non-transitory computer readable medium of claim 32, wherein when the conditional offer requires use of the electronic bonus game device, further comprises outputting an identifier of the electronic bonus game device.

38. The non-transitory computer readable medium of claim 37, wherein the identifier of the electronic bonus game device comprises at least one of a display of information concerning the electronic bonus game device including at least one of: a game name, a game type, a game manufacturer, a plurality of game play instructions, a location of the electronic bonus game device, a map that includes the location of the electronic bonus game device, a printout of a map showing the location of the electronic bonus game device, a printout containing information concerning information associated with the electronic bonus game device, an alert to a casino employee to guide the player to the electronic bonus game device, and a plurality of instructions concerning the electronic bonus game device transmitted to a player device.

39. The non-transitory computer readable medium of claim 32, further directing the processor to, prior to providing the conditional offer, store at least one indication that the player is due the at least one benefit.

40. The non-transitory computer readable medium of claim 32, wherein providing the offer further comprises providing at least one indication that the player must use the electronic bonus game device.

41. The non-transitory computer readable medium of claim 40, wherein the at least one indication further comprises a notice of at least one of: at least one gaming credit, a prize, an award, a mystery prize, and an explanation of why the player qualifies for the at least one benefit.

42. The non-transitory computer readable medium of claim 32, wherein receiving the request for the at least one benefit comprises at least one of: an actuation of at least one button, an actuation of a touch screen, a receipt of an identifier associated with the at least one benefit, and a receipt of an identifier associated with the player.

43. The non-transitory computer readable medium of claim 42, wherein the identifier associated with the at least one benefit comprises at least one of: a receipt, a bonus receipt, a cashout ticket, a bonus ticket, a voucher, a token, an encoded chip, a barcode, and a code.

44. The non-transitory computer readable medium of claim 42, wherein the identifier associated with the player comprises at least one of: a player tracking card, a cashless gaming ticket, a player identifier code, a personal identification number, and a biometric identifier.

45. The non-transitory computer readable medium of claim 32, further directing the processor to, prior to providing the at least one benefit, determine whether to enable the player to redeem the at least one benefit.

46. The non-transitory computer readable medium of claim 45, further directing the processor to:

obtain an identifier associated with the player;

determine at least one parameter associated with the player; and permit the at least one benefit to be provided if the player satisfies at least one predetermined criteria.

47. The non-transitory computer readable medium of claim 46, wherein the at least one predetermined criteria comprises at least one of: a valid player tracking card, a valid personal identification number, a valid cashout ticket, and deposit of a predetermined minimum amount of money.

48. The non-transitory computer readable medium of claim 46, wherein determining the at least one parameter further comprises at least one of: accessing at least one database, reading data from a ticket, and reading data from a magnetic stripe.

49. The non-transitory computer readable medium of claim 46, further directing the processor to provide an indication of the at least one benefit by at least one of: an audio message, a video message, a plurality of written instructions, a message that the player is eligible to win at least one predetermined prize, a message that at least one probability table has been modified, a message that at least one probability of at least one gaming outcome has been modified, and a message that at least one feature of the electronic bonus game device has been enabled, disabled or altered.

50. The non-transitory computer readable medium of claim 49, further directing the processor to display the indication at least one of: when the player initially requests the at least one benefit, during a play of a wagering game and during the play of the bonus game.

51. The non-transitory computer readable medium of claim 32, further directing the processor to deny the request for the at least one benefit if the player does not satisfy the at least one condition.

52. The non-transitory computer readable medium of claim 32, further directing the processor to:

generate at least one random number;

select an entry of the selected paytable based on the random number; and provide at least one payout based on the selection.

53. The non-transitory computer readable medium of claim 52, wherein the paytable is selected by at least one of: a random determination, a determination based on at least one player criteria, and a determination based on at least one gaming criteria.

54. The non-transitory computer readable medium of claim 32, further directing the processor to, prior to providing the at least one benefit, determine the expected value of the at least one benefit by:

determining a plurality of paytables;

generating a plurality of masked awards, wherein each masked award is associated with one of the determined paytables;

providing the masked awards for selection by the player after receiving the request for the at least one benefit; and determining a benefits paytable corresponding to the masked award selected by the player.

55. The non-transitory computer readable medium of claim 32, further directing the processor to store data representing the at least one benefit in a memory of at least one of: a dedicated storage device, at least one of the electronic game devices, at least one electronic game server, and a casino server.

56. The non-transitory computer readable medium of claim 55, further directing the processor to provide access to at least a portion of the stored data to at least one of: an authorized casino personnel, a regulator, and the player.

57. The non-transitory computer readable medium of claim 55, further directing the processor to:

analyze the stored data for a plurality of players;

determine at least one trend based on the analysis; and modify at least one criteria used in determining at least one future benefit offer.

58. An electronic game device comprising:

a processor;

a payment system;

at least one display device;

at least one player input device; and a memory which stores a program including a plurality of instructions which when executed by the processor, cause the processor to operate with said payment system, said at least one display device, and said at least one play input device to:

accept payment from a player to play a wagering game;

determine that the player qualifies to receive at least one benefit that is associated with an expected award value which is distinct from a quantity of monetary credits indicated by a credit meter;

output an offer to the player to obtain the at least one benefit, wherein the offer includes at least one condition that must be satisfied by the player and the at least one benefit is associated with an actual award value based, at least in part, on at least one random determination associated with a play of a game at another electronic game device, said play of the game at the other electronic game device employing a paytable selected based on the expected award value associated with the at least one benefit, wherein if the at least one benefit is associated with a first expected award value, a first paytable associated with the first expected award value is selected and if the at least one benefit is associated with a second, different expected award value, a second, different paytable associated with the second, different expected award value is selected; and store data representing the at least one benefit.

59. The electronic game device of claim 58, wherein the processor is operative to monitor for the occurrence of a trigger condition, and to determine the offer for the at least one benefit based on the occurrence of the trigger condition.

60. The electronic game device of claim 58, wherein the trigger condition comprises at least one of: a random generation, a player status, a time and a date consideration, a game device availability, a game device utilization, a game device performance history, the player exceeding a threshold value of a plurality of losing outcomes, the player exceeding a predetermined threshold value associated with a duration of playing time, and the player exceeding a predetermined percentage decline in a credit balance.

61. The electronic game device of claim 58, further comprising at least one of: a peripheral device, a smart card, a USB key device, a personal digital assistant, a handheld device, and a casino personnel device configured to access the memory and to obtain the stored data representing the at least one benefit.

* * * * *